US006109740A

United States Patent [19]

Namekawa et al.

[11] Patent Number: 6,109,740

[45] Date of Patent: Aug. 29, 2000

[54] METHOD AND APPARATUS FOR SUPPLYING INK TO A PRINTER

[75] Inventors: Takumi Namekawa, Kanagawa; Hiroshi Tokunaga, Tokyo; Shinichi Horii, Kanagawa, all of Japan

[73] Assignee: Sony Corporation, Tokyo, Japan

[21] Appl. No.: 08/985,858

[22] Filed: Dec. 5, 1997

[30] Foreign Application Priority Data

Dec. 9, 1996 [JP] Japan ..... P08-346705

[51] Int. Cl.[7] ..... B41J 2/175

[52] U.S. Cl. ..... 347/85

[58] Field of Search ..... 347/85, 86, 87, 347/7

[56] References Cited

U.S. PATENT DOCUMENTS

| | | | |
|---|---|---|---|
| 5,136,305 | 8/1992 | Ims | 347/7 |
| 5,159,348 | 10/1992 | Dietl et al. | 347/89 |
| 5,489,932 | 2/1996 | Ceschin et al. | 347/87 |

FOREIGN PATENT DOCUMENTS

| | | |
|---|---|---|
| 62-161544 | 7/1987 | Japan . |
| 63-118259 | 5/1988 | Japan . |

*Primary Examiner*—N. Le
*Assistant Examiner*—Michael Nghiem
*Attorney, Agent, or Firm*—Jay H. Maioli

[57] ABSTRACT

A printer is selectively supplied with ink by moving a print head to an end position and bringing an ink supply element into contact with an ink absorbing material in the print head. At that time ink can be supplied to the ink absorbing material in the print head either by pressing a flexible bag containing an ink supply or by capillary action from another ink absorbing material that is impregnated with ink and that has a capillary force smaller than a capillary force of the ink absorbing material of the print head. The ink supply device is located at one end of a platen for the printer and can be rotated out of position until the print head moves to the end of the platen, at which time the ink supply device is rotated into contact with the print head. An arrangement of rotating a discoid cam can be used to apply a pressing force to the flexible bag, which includes a self-sealing valve, so that ink flows to the ink absorbing material in the print head.

4 Claims, 21 Drawing Sheets

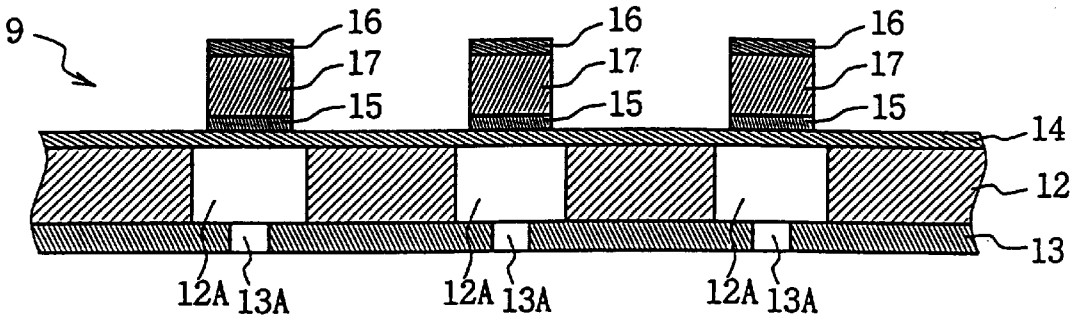
FIG. 22 (PRIOR ART)
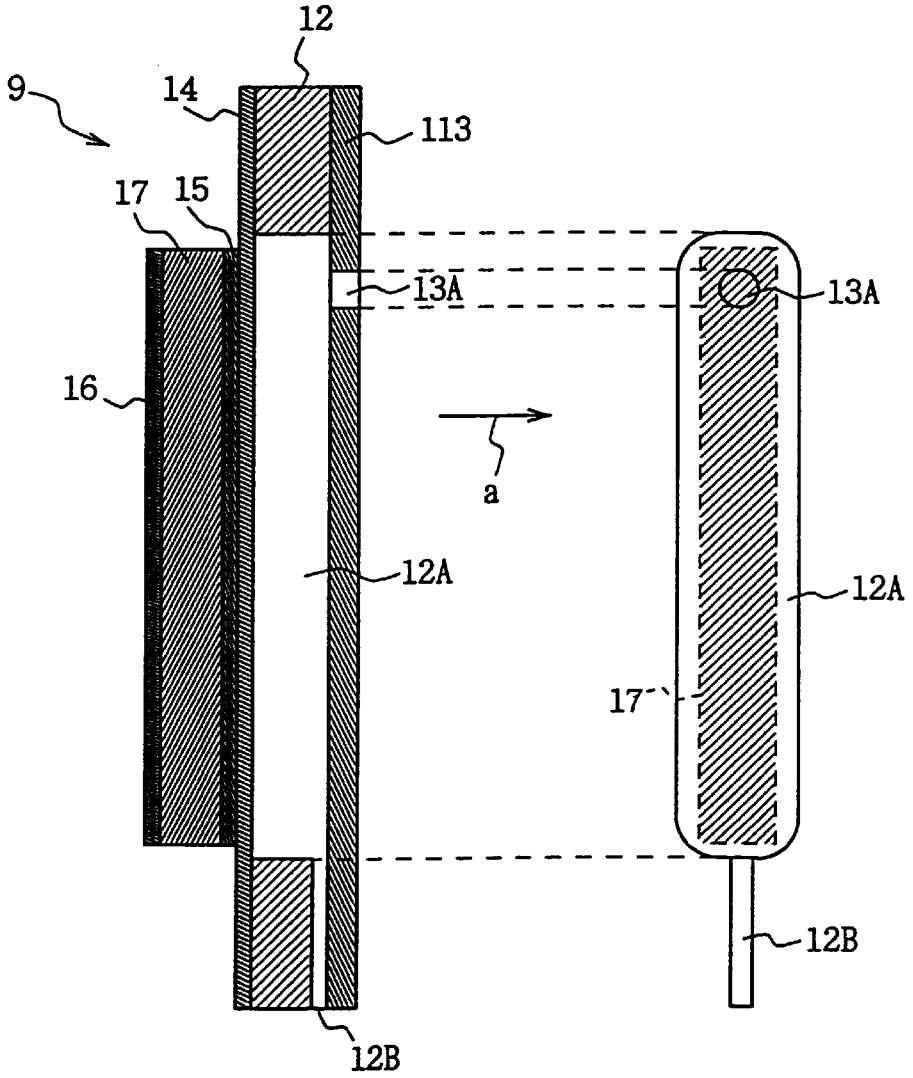
FIG. 23 (A) (PRIOR ART)
FIG. 23 (B) (PRIOR ART)

METHOD AND APPARATUS FOR SUPPLYING INK TO A PRINTER

BACKGROUND OF THE INVENTION

1. Field of the Invention

This invention relates generally to a system for supplying into and, more particularly, to a system for supplying colored inks to an on-demand-type ink jet printer.

2. Description of Background

A conventional so-called on-demand-type ink jet printer records data on a recording medium, such as a sheet of paper or film, by discharging ink droplets from a nozzle in accordance with a printing signal. This kind of printer has recently rapidly spread in popularity, because the size and the cost of the printer have been steadily minimized.

On the other hand, in recent years, the procedure referred to as desk-top publishing using a personal computer has become increasingly popular, particularly in offices. Moreover, requests for outputting not only characters and graphics but also colored natural images, such as photos, have also been recently increasing. Thus, a lot of ink is required to print not only characters and graphics but also natural images.

This kind of on-demand-type ink jet printer typically includes an ink tank mounted on a carriage for holding a print head and feeding ink to the print head simultaneously with the printing operation of the print head. This kind of ink supply is hereinafter referred to as the carriage-mounting type. Another approach to supplying ink is to use an ink tank arranged separately from the print head and to feed ink to the print head through a tube. This kind of ink supply hereinafter referred to as the tube type.

FIG. 21 shows a carriage-mounting-type serial ink jet printer, in which the ink jet printer 1 is constructed so that a platen 6 is rotated in accordance with a rotary drive supplied to the platen 6 through a motor 2, pulley 3, belt 4, and platen shaft 5. A feed screw 7 is mounted nearby to the platen 6 in parallel with the longitudinal axis of the platen 6 and a carriage 10 on which a cartridge-type ink tank 8 and a print head 9 are integrally mounted is threadedly engaged with the feed screw 7. Thus, by rotating the feed screw 7 it is possible to move the carriage 10 back and forth in the axial direction along the platen 6. Therefore, the print head 9 can print onto a paper 11 wound on the platen 6, one line by one line, under the condition of being fed ink from the ink tank 8 mounted on the carriage 10.

In general, this type of on-demand-type ink jet printer uses either a method of discharging ink from a nozzle by pressurizing the ink in accordance with the deformation of a piezoelectric element or a method of discharging ink in accordance with the pressure of bubbles produced by boiling the ink with an exothermic element. In the method of discharging ink from a nozzle by pressurizing the ink in accordance with the deformation of a piezoelectric element, a diaphragm is pressed by linearly displacing a piezoelectric element formed by superimposing several layers of piezoelectric material or a diaphragm is curved or deformed by applying a voltage to a piezoelectric element made of a single layer or two layers of piezoelectric material bonded to the diaphragm.

FIGS. 22 and 23(A) show the print head 9 of the printer 1 shown in FIG. 21 using a single-layer piezoelectric element as the printer head 9, which has an orifice plate 13 with a plurality of discharge nozzles 13A formed in it bonded to one side of a base 12 made of, for example, photosensitive glass and of a diaphragm 14 bonded to the other side of the base 12. A piezoelectric element 17 having electrodes 15 and 16 bonded to respective sides in the thickness direction is firmly bonded to the diaphragm 14 at positions corresponding to pressure chambers 12A formed in the base 12 by an adhesive or the like, not shown in the drawings.

In this case, as shown in FIG. 23(B), the pressure chamber 12A for storing ink and an ink introducing hole 12B communicating with the pressure chamber 12A are formed in the base 12. The pressure chamber 12A of the base 12 communicates with the corresponding discharge nozzle 13A of the orifice plate 13. Thus, the ink supplied from an external ink tank, not shown in FIG. 23(B), is injected through the ink introducing hole 12B and then stored in the pressure chamber 12A.

The piezoelectric element 17 comprises a bimorph element made of baked ceramic and has the feature in which, by applying a predetermined voltage between the electrodes 15 and 16 bonded to the both sides in the thickness direction, the element 17 is deformed in the thickness direction in accordance with the applied voltage. This feature is hereinafter referred to as the bimorph effect.

In the case of the print head 9, when applying a voltage to the piezoelectric element 17 in the initial state as shown in FIGS. 23(A) and 23(B), the piezoelectric element 17 shrinks inwardly and curves in the direction of the arrow "a" due to the bimorph effect of the piezoelectric element 17 and the diaphragm 14 and thereby, the and thereby the diaphragm 14 also curves in the direction of the arrow "a". Therefore, the displacement of the piezoelectric element 17 is transmitted to the pressure chamber 12A through the diaphragm 14. As a result, a pressure corresponding to the displacement of the piezoelectric element 17 is applied to the pressure chamber 12A, the volume of the pressure chamber 12A decreases and the pressure in the pressure chamber 12A rises, and thus the ink filling the pressure chamber 12A is discharged from the discharge nozzle 13A.

FIGS. 24(A) and 24(B) represent a cartridge-type ink tank 8. The tank 8 has a structure in which cartridge bodies 20A to 20C having the same structure are integrally formed corresponding to three colored inks such as magenta, cyan, and yellow.

In the case of the cartridge body 20A as shown in FIG. 24(B), an ink absorber storing chamber 20AX in which an ink absorber 21 is compressed and stored communicates with a closed-type ink storing chamber 20AY in which ink is stored through a communicating hole 20AZ formed at the bottom end of the chamber. A plurality of air introducing holes 20AH for introducing air to the inside are formed at the top side of the ink absorber storing chamber 20AX, and an ink feed port 20AS for feeding ink to the print head 9 is formed at the bottom side of the chamber 20AX. Cartridge bodies 20B and 20C are formed just like cartridge body 20A.

The ink absorber 21 itself is formed of, for example, a cellular material such as polyurethane foam made of a foaming material. By becoming impregnated and holding the ink, it is possible for the ink absorber 21 to prevent the ink from leaking from the ink feed port 20AS or from the air introducing holes 20AH.

When supplying the ink in the ink tank 8 to the print head 9, an injection needle, not shown in FIGS. 24(A) and 24(B), connected to the print head 9 is inserted into the ink absorber 21 through the feed port 20AS.

To feed ink to the print head 9 by using the ink tank 8, it is first necessary to make the ink absorber 21 hold an amount of ink slightly smaller than the maximum amount of ink that it can hold. Then, because a negative pressure is produced in the print head 9 due to the pressure produced by the displacement of the piezoelectric element 17 in the print head 9, as shown in FIG. 23(A), the ink held in the ink absorber 21 is conducted to the print head 9 through the injection needle.

In this case, because meniscuses are produced in the ink absorber 21 at the side of air introducing holes 20AH and generate a capillary force, that is, an ink soaking-up force, in the ink absorber 21, a predetermined negative pressure is produced in the ink absorber storing chamber 20AX. Therefore, it is possible to prevent an excessive amount of ink from leaking to the print head 9 from the ink absorber 21 and, thus, the print head 9 can perform stable discharge of ink droplets.

FIG. 25, in which the same reference numerals are applied to parts corresponding to those of FIG. 21, shows a tube-type serial ink jet printer 30. In the case of the ink jet printer 30, an ink tank 31 is arranged separately from a carriage 32 and communicates with a print head 34 fixed to the carriage 32 through an ink tube 33 connected to the ink tank 31. A tube pump 35 is set between the print head 34 and the ink tank 31, so as to feed the ink stored in the ink tank 31 to the print head 34 through the ink tube 33 by driving and controlling the tube pump 35.

FIG. 26 shows the internal structures of the ink tank 31 and the tube pump 35. In the case of the ink tank 31, an ink storing bag 37, whose front end is closed by a rubber cap 36, is set in a case body 31A, and a communicating ink needle 38 is inserted by passing it through the rubber cap 36. The communicating ink needle 38 places the ink storing bag 37 and the tube 33 in fluid communication, so that the ink in the ink storing bag 37 enters the tube 33 by passing through the communicating tube needle 38.

In the tube pump 35, a cylindrical space 35AX is formed in a body 35A, and a through-hole 35AY communicating with the space 35AX and the outside is formed in the body 35A. The tube 33 is inserted into the through-hole 35AY. In the space 35X, a rotating member 40 is attached to an output shaft 41 of a motor, not shown in FIG. 26, so as to rotate in the direction of the arrow "a" by using the output shaft 41 as a rotation center. Furthermore, a plurality of rollers 42A, 42B, 42C are mounted on the periphery of the rotating member 40, so as to freely rotate about their respective mounting centers. Rotating member 40 then rotates in the direction of the arrow "a" and rollers 42A, 42B, 42C rotate in the direction opposite to the direction of the arrow "a" about respective shafts arranged parallel with the output shaft 41 as roller rotation centers.

Thus, by rotating the rotating member 40 in the direction of the arrow "a" in response to driving by the motor, the tube 33 in the space 35AX is successively pressed by the rollers 42A, 42B, 42C, whereby the ink in the tube 33 is ejected to the print head 34. The ink supply amount can be adjusted by controlling the motor rotation rate, so that as a result the print head 34 can perform stable discharge of ink droplets.

In the carriage-mounting-type ink jet printer 1, the ink tank 8 shown as FIGS. 24(A) and 24(B) is in the form of a cartridge having the ink absorber 21 built in. Therefore, there is the advantage that the entire structure of the printer 1 can be simplified and reduced in size. Nevertheless, the amount of ink that can be stored is relatively small compared to the entire volume of the ink tank 8 and the amount of ink that can be impregnated by the ink absorber 21 is restricted by the material and quantity of the ink absorber 21. Therefore, there is a problem that it is very difficult to store a large amount of ink in the ink tank 8. Moreover, because a negative pressure in the ink tank is adjusted by the ink absorber, there are also the problems that it is impossible to completely prevent ink from leaking to the print head or from being insufficiently fed to the print head.

On the other hand, in the tube-type ink jet printer 30, because the ink tank 31 shown in FIG. 25 is arranged separate and apart from the print head 34, there is the advantage that larger and larger amounts of ink can be stored in the ink tank simply by increasing the volume of the tank. Nevertheless, an ink feed source such as the tube pump 35 or a valve mechanism (not shown) is necessary to feed the ink stored in the ink tank 31 to the print head 34. Therefore, there is a problem that it is difficult to reduce the size of the entire printer and simplify the overall structure. Moreover, the tube 33 is typically connected for a long distance between the print head 34 and the ink tank 31, so that the ink feed is easily interrupted and air that is dissolved in the ink in the tube 33 may appear as bubbles when the tube 33 is physically deflected. In that case, there is the problem that not only ink but also air bubbles may enter the print head 34 through the tube 33 and the feed of ink to the print head is interrupted.

OBJECTS AND SUMMARY OF THE INVENTION

The present invention is intended to solve the above described problems and has as an object to provide a printer and ink supplying method capable of storing a large amount of ink with a simple structure and to improve the reliability of the ink supply to a print head.

To solve the above problems, according to the present invention the printer that prints a recording medium with ink by discharging ink from a print head to the recording medium is formed with a carriage including the print head for storing a fixed amount of ink to be discharged from the print head, a power driver which is located within a movable range of the print head and is arranged corresponding to a predetermined maintenance position for performing maintenance of the print head, and an ink storing device arranged corresponding to the maintenance position for feeding the ink to the carriage under the condition in which the print head is positioned under the maintenance position.

Further, in the present invention, in the ink feeding method for supplying ink to the print head of the printer, the print head is moved to a predetermined maintenance position previously set to be within the movable range of the print head, and then a fixed amount of the ink is supplied to the print head.

In this way, operation of supplying ink to the print head can be performed at the maintenance position where the maintenance of the print head is performed, so that the ink supply to the print head can be performed concurrently with the maintenance of the print head. As a result, the print head can more efficiently print, without undergoing several operations to assure a proper ink supply.

BRIEF DESCRIPTION OF THE DRAWINGS

FIG. 22 is a cross section showing a structure of a conventional print head.

FIGS. 23(A) and 23(B) are a cross section and elevational view, respectively, showing a structure of the conventional print head.

DETAILED DESCRIPTION OF PREFERRED EMBODIMENTS

Embodiments of the present invention will be described below in detail by referring to the accompanying drawings.

Figure 1:
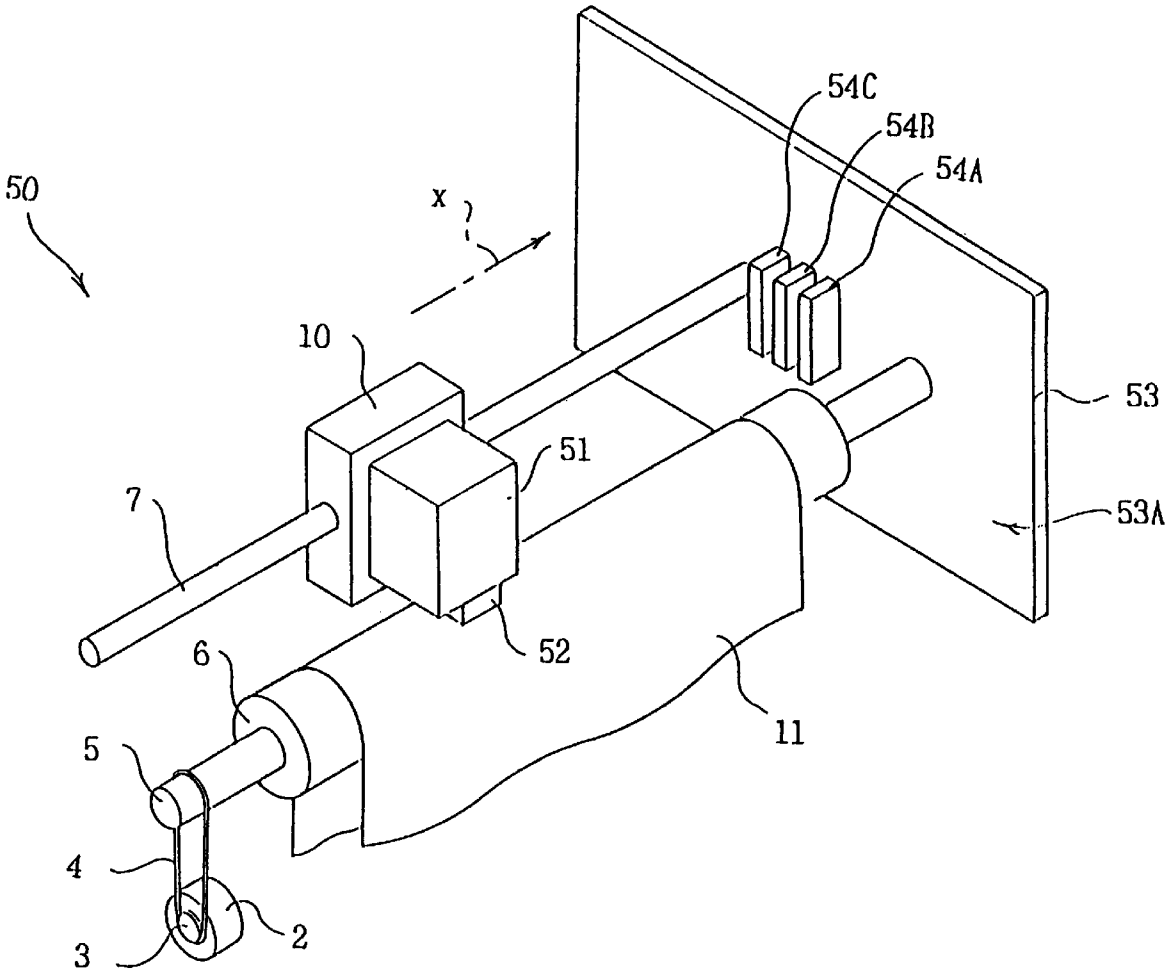
FIG. 1 is a schematic perspective view showing the structure of an ink jet printer according to a first embodiment of the present invention.
Figure 21:
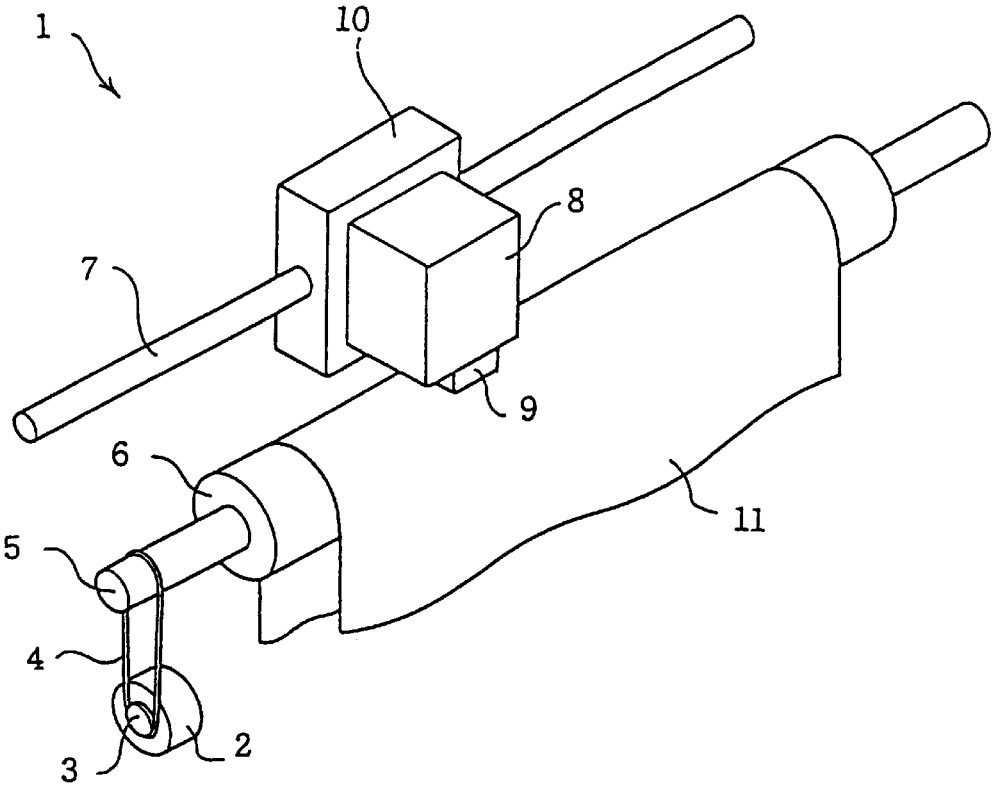
FIG. 21 (PRIOR ART)
FIG. 21 is a perspective view showing the structure of a conventional ink jet printer of the carriage mounting type.
Figure 24:
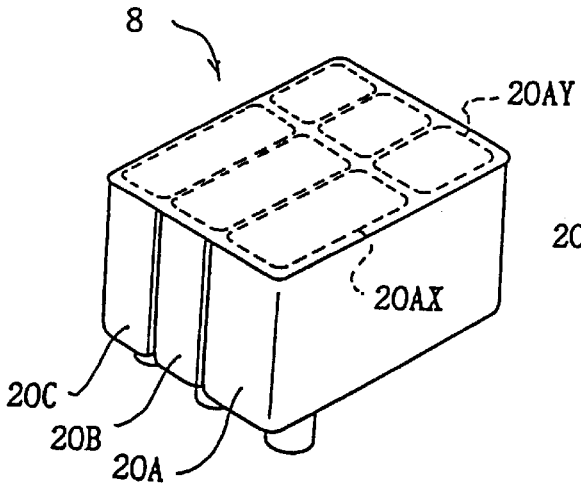
FIG. 24 (A) (PRIOR ART)
FIGS. 24(A) and 24(B) are a perspective view and a cross section, respectively, showing the structure of a conventional ink tank.
Figure 24:
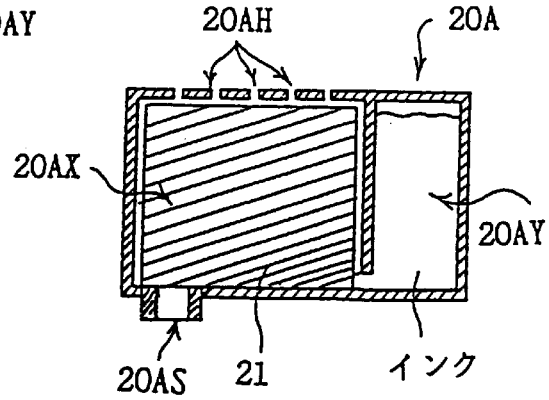
FIG. 24 (B) (PRIOR ART)

In FIG. 1, in which the same numerals are applied to parts corresponding to those of FIG. 21, symbol 50 denotes a serial ink jet printer of the carriage-mounting type in which the present invention is embodied. The serial ink jet printer is different from the conventional ink jet printer 1 shown in FIG. 21 in regard to the structures of an ink tank 51 and a print head 52, and protrusions 54A, 54B, 54C each having the same shape formed on an inside plane surface 53A of a side plate 53 that supports the ends of the rotary platen shaft 5 and the feed screw 7.

Figure 2:
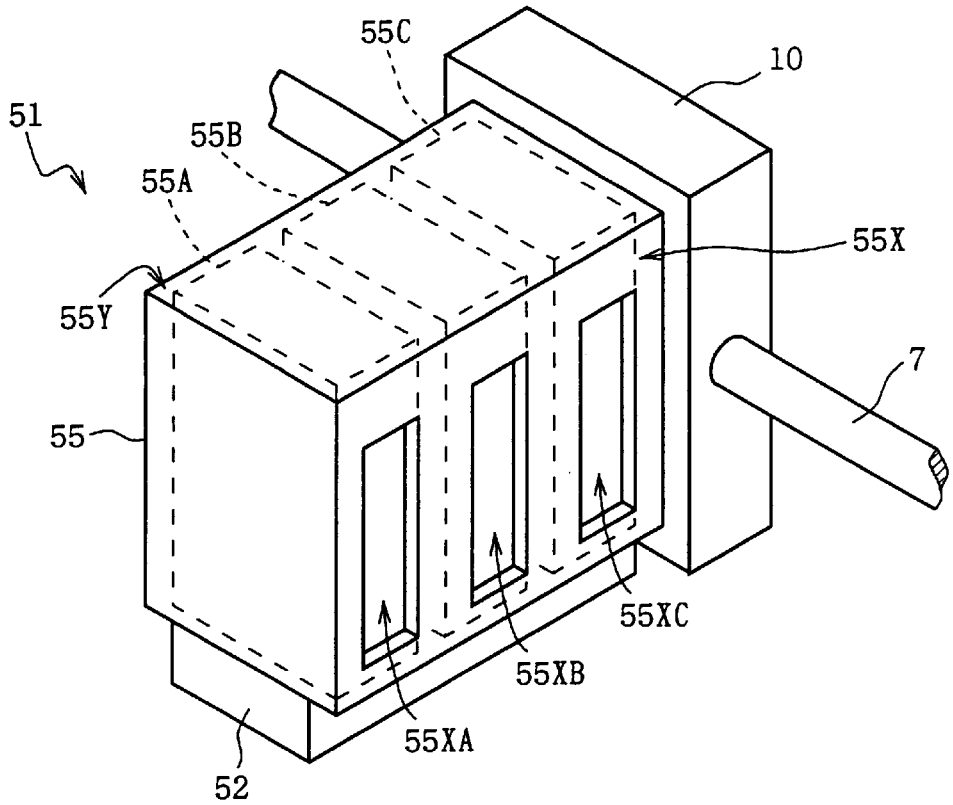
FIG. 2 is a schematic perspective view showing the outside structure of an ink tank used in the first embodiment.

The ink tank 51 has an external structure as shown in FIG. 2, in which ink bag storing chambers 55A, 55B, 55C each having the same shape are formed in a case body 55. The three chambers correspond to three color inks of magenta, cyan, and yellow. A valved ink storing bag, not shown in FIG. 2, is contained in each of the ink bag storing chambers 55A, 55B, 55C. Through-holes or slots 55XA, 55XB, 55XC are formed in a plane surface 55X of the case body 55 that faces the side plate 53 and respectively correspond to the ink bag storing chambers 55A, 55B, 55C, so that the valved ink storing bag contained in each of the ink bag storing chambers 55A, 55B, 55C is partially exposed.

When the carriage 10 is moved by the feed screw 7 in the axial direction of the platen 6, as shown by arrow "X" in FIG. 1, and reaches the inside plane surface 53A of the side plate 53, the protrusions 54A, 54B, 54C formed on the inside plane surface 53A are fitted into the corresponding through-holes 55XA, 55XB, 55XC, respectively, so as to press each valved ink storing bag.

The upper side or top 55Y of the case body 55 is formed as a lid that can be opened or closed, so as to insert or remove the valved ink storing bags by opening the upper side 55Y, that is, by opening the top end of the ink bag storing chambers 55A, 55B, 55C.

The structure and functions of a valved ink storing bag 60 are described with reference to FIGS. 3(A) and 3(B). The valved ink storing bag 60 is formed by welding the margins of two polyester-film sheets together, and an ink injecting portion 60A filled with ink and an S-shaped ink channel 60B communicating with the bottom end of the ink injecting portion 60A are confined within the welded margin.

A front or lower end 60BX of the ink channel 60B is closed by the welded film portion. Then, when the bag 60 is used the front end 60BX of the ink channel 60B can be opened by the user cutting off a section of the bag 50 along line 60C formed on the side end of the welded portion using scissors or the like and cutting in the direction of arrow "a" in FIG. 3(A).

When the user presses the ink injecting portion 60A from the outside after the section 60C of the valved ink storing bag 60 has been opened, an amount of ink corresponding to the applied pressure will be discharged from the ink injecting portion 60A to the ink channel 60B. When the pressure is removed, ink flow stops. This characteristic is hereinafter referred to as a self-sealing performance.

The self-sealing bag operates so that even if the front end 60BX of the ink channel 60B of the valved ink storing bag 60 is turned downward in the gravitational direction, the ink in the ink injecting portion 60A is kept in the ink channel 60B due to the resistances of the inner walls of the ink injecting portion 60A and ink channel 60B, unless some pressure is applied to the ink injecting portion 60A from the outside.

It should be noted that to maintain the self-sealing performance of the valved ink storing bag 60, it is necessary to set the diameter of the ink channel 60B and the curvature of the S-shaped channel in accordance with the viscosity of ink. That is, when the ink has a high viscosity, it is necessary to increase the channel diameter and/or decease the curvature of the S shape. On the other hand, when the ink has a low viscosity, it is necessary to decrease the channel diameter and/or increase the curvature of the S-shaped channel.

Figure 4A:
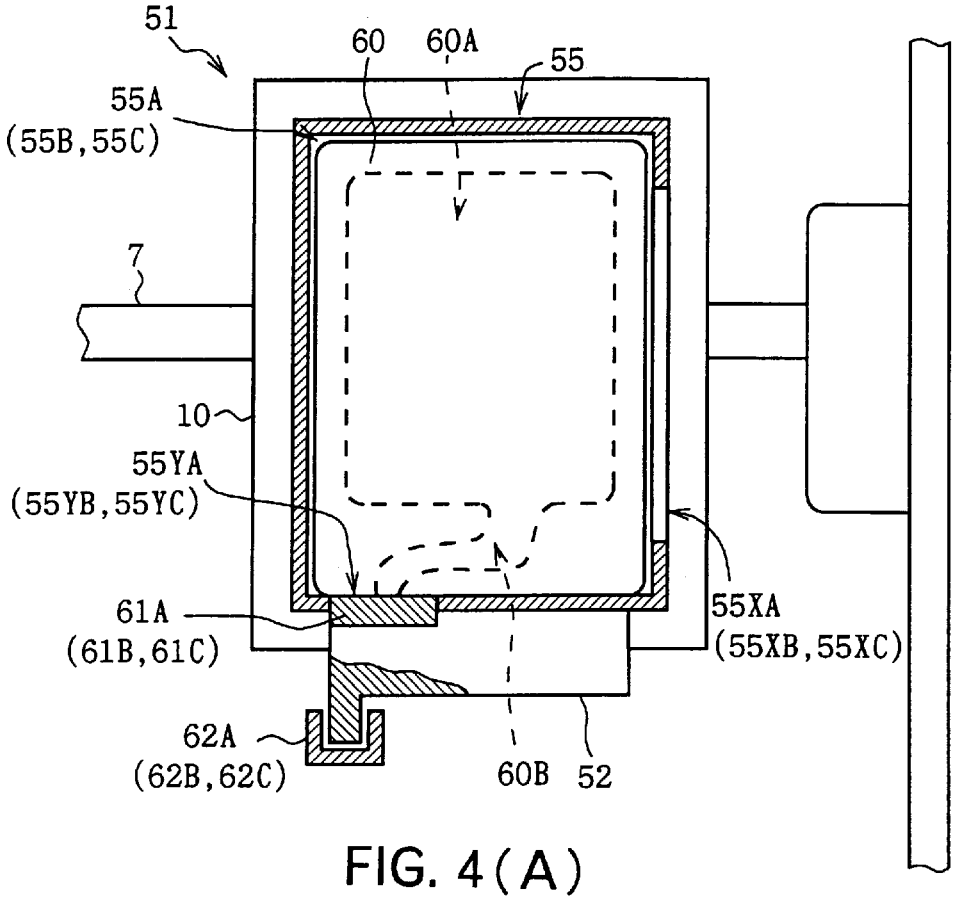
FIGS. 4(A) and 4(B) are partial cross sections showing the structure of an ink tank of the first embodiment.
Figure 4:
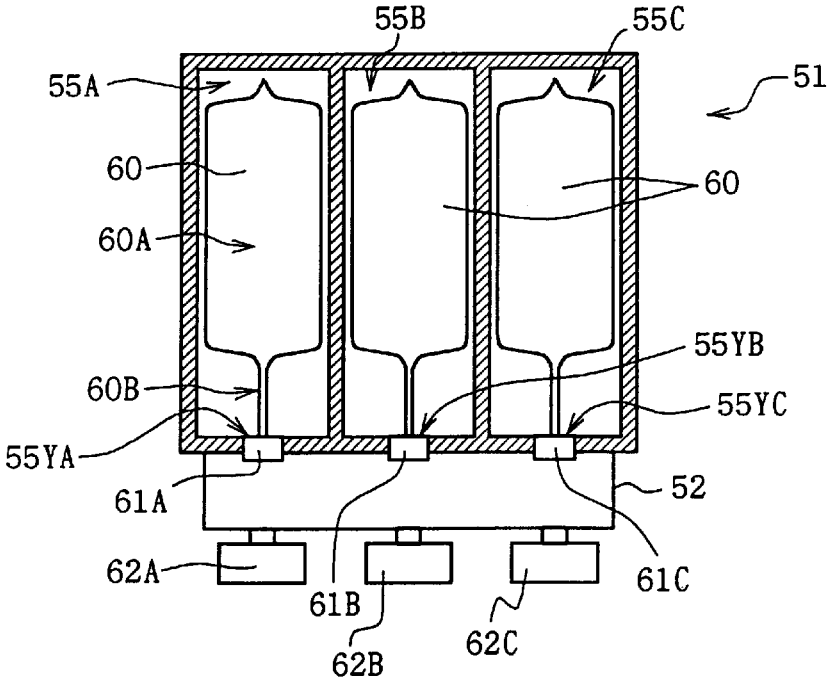

FIGS. 4(A) and 4(B) show cross sections of the ink tank 51 shown in FIG. 2 taken along section lines perpendicular to the axial direction of the feed screw 7. Ink feed ports 55YA, 55YB, 55YC for feeding ink to the print head 52 are formed at the bottom ends of the ink bag storing chambers 55A, 55B, 55C in the case body 55, respectively, and ink absorbers 61A, 61B, 61C are set in the ink feed portions 55YA, 55YB, 55YC, respectively.

The ink absorbers 61A, 61B, 61C are formed of a cellular substance such as polyurethane foam made of a foaming material. Thereby, the ink discharged from the front end 60BX of the ink channel 60B of the valved ink storing bag 60 is impregnated and held by the ink absorbers 61A, 61B, 61C set in the ink feed portions 55YA, 55YB, 55YC due to the capillary forces of the foam ink absorbers 61A, 61B, 61C. Thus, only when a pressure is applied from the outside of the individual valved ink storing bag 60 in each of the ink bag storing chambers 55A, 55B, SSC will an amount of ink corresponding to the applied pressure be fed to the print head 52.

Remaining ink sensors 62A, 62B, 62C are set to the bottom end of the print head 52 respectively correspondingly to the ink feed ports 55YA, 55YB, 55YC. The respective remaining-ink sensors 62A, 62B, 62C are used to determine the amounts of the three kinds of ink to be fed to the print head 52 from the ink tank 51.

Figure 5:
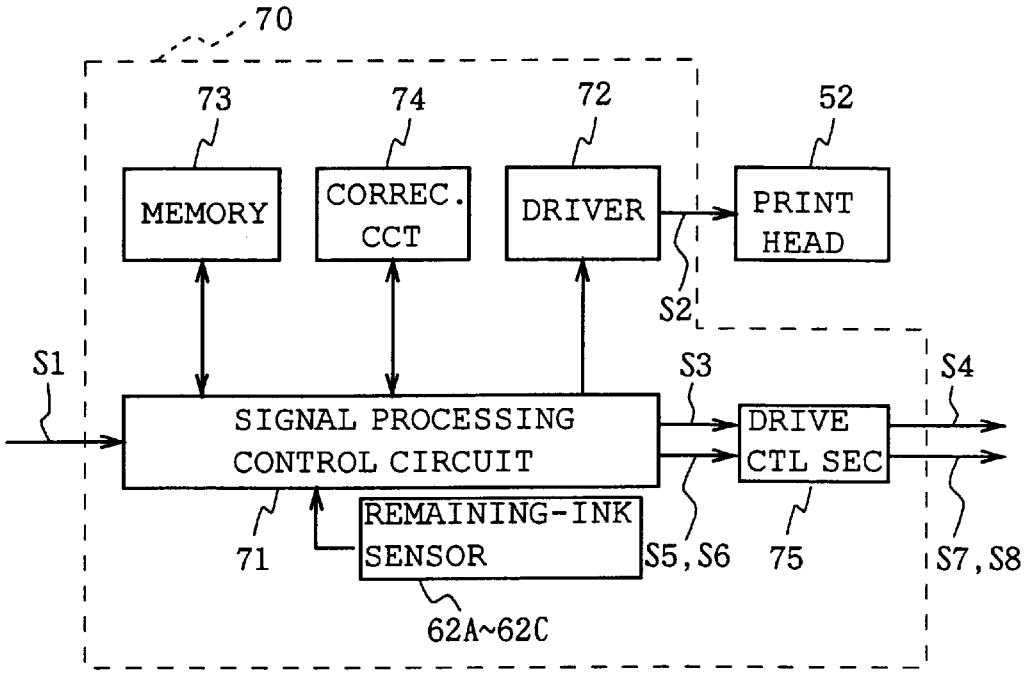
FIG. 5 is a block diagram useful for explaining the structure of a control section of the ink jet printer of the first embodiment.

Practically, as shown in FIG. 5 a control section 70 of the serial ink jet printer 50 has a signal processing control circuit 71 comprising a microcomputer including a Central Processing Unit (CPU) or Digital Signal Processor (DSP), so as to drive and control the print head 52 by generating a driving signal S2 in accordance with a supplied input signal S1 and transmitting the signal S2 to the print head 52 through a print head driver 72.

In this case, the signal processing control circuit 71 stores print data obtained in accordance with the input signal Si in a memory 73 comprising a line buffer memory or a one-screen memory according to necessity, and then rearranges the print data in the order of printing by properly reading out the print data. The signal processing control circuit 71 also reads correction data stored in a correction circuit 74 in the form of a Read Only Memory-map (ROM) format according to necessity and corrects a γ-correction value of the print data or colors in accordance with the correction data.

The signal processing control circuit 71 also computes the remaining amount of ink in each valved ink storing bag 60 set in the ink tank 51 in accordance with a measurement result of the amount of ink fed from each valved ink storing bag 60 as detected by each of the remaining-ink sensors 62A, 62B, 62C and, thereafter, transmits the computed result of the one of the valved ink storing bags 60 having the minimum remaining amount of ink out of the three valved ink storing bags 60 to a drive control section 75 as a control signal S3. The drive control section 75 computes the rotation value of the feed screw 7, that is, the distance the carriage 10 should move in the direction of the arrow "x" in FIG. 1 corresponding to the remaining amount of ink in each valved ink storing bag 60 in accordance with the control signal S3 and, thereafter, transmits the computed result to a driving motor, not shown, for the feed screw 7 as a drive control signal S4.

The driving motor for the feed screw 7 adjusts the extent by which the protrusions 54A, 54B, 54C fit respectively into the through-holes 55XA, 55XB, 55XC by moving the feed screw 7 a predetermined distance in the direction of the arrow "x" in accordance with the drive control signal S4.

The signal processing control circuit 71 drives and controls the platen motor 2 and the driving motor for the feed screw 7 by generating control signals S5 and S6 in accordance with the input signal S1 and transmitting the signals S5 and S6 to the corresponding platen motor 2 or the driving motor for the feed screw 7 as drive control signals S7 and S8 through the drive control section 75 and thereby controls the operations of the platen 6 and feed screw 7.

Thus, the serial ink jet printer 50 moves the print head 52 in the axial direction of the platen 6 at a constant speed when the driving motor for the feed screw 7 makes the feed screw 7 rotate at a predetermined angular speed in accordance with the drive control signals S4 and S8 supplied from the control section 70 during operation and at that time prints data for one line on the printer paper 12 because the print head 52 is driven in accordance with the driving signal S2 supplied from the control section 70.

When the printing of data for one line is completed, the motor 2 operates in accordance with the drive control signal S7 supplied from the control section 70 to rotate the platen 6 through a predetermined angle and thereby feed the print paper 12 by one line. In this case, the driving motor for the feed screw 7 operates in accordance with the drive control signal S8 supplied from the control section 70 to rotate the feed screw 7 and thereby return the print head 52 to its original or index position. Thereafter, the same operations are repeated.

It should be noted that when the remaining amount of ink in each valved ink storing bag 60 as calculated by the signal processing control circuit 71 and the three remaining ink sensors 62A, 62B, 62C decreases, the driving motor for the feed screw can apply an optimum pressure to the valve-provided ink storing bags 60 by moving the feed screw 7 up to a predetermined distance in accordance with the drive control signal S4 and thereby feed a stable amount of ink to the print head 52.

Therefore, the serial ink jet printer 50 can continue to print one line by one line in accordance with the input signal S1 supplied to the control section 70 and can print characters, graphics, and images based on the print data obtained from the input signal S1 on the entire surface of the print paper 12.

In the case of the above structure, three valved ink storing bags 60 storing inks with different colors are set in the ink bag storing chambers 55A, 55B, 55C respectively after opening each section 60C and turning the front end 60BX of the ink channel 60B downward in the gravitational direction, without applying any pressure to the ink injecting portion 60A of each valved ink storing bag 60 from the outside.

In this case, the front end 60BX of the ink channel 60B of each valve-provided ink storing bag 60 is in contact with the ink absorbers 61A, 61B, 61C set in the ink feed ports 55YA, 55YB, 55YC, respectively. Since the self-sealing performance of each valved ink storing bag 60 functions, no ink leaks from the front end 60BX of each ink channel 60B will occur.

Then, a desired amount of ink is discharged from the front end 60BX of the ink channel 60B communicating with each ink injecting portion 60A by applying a slight pressure to the ink injecting portion 60A of each valved ink storing bag 60 from the outside, in order to be impregnated into a corresponding one of the ink absorbers 61A, 61B, 61C. In this case, since a capillary force is produced in the ink absorbers 61A, 61B, 61C, it is possible to prevent an excessive amount of ink from entering the print head 52 from the ink absorbers 61A, 61B, 61C.

If the remaining amount of ink up one or all of the colors in the ink absorbers of the print head 52 is calculated to decrease while the ink jet printer 50 operates, the carriage 10 mounting the ink tank 51 is moved toward the side plate a predetermined distance and the protrusions 54A, 54B, 54C formed on the side plate 53 press the valved ink storing bags 60 set in the ink bag storing chambers 55A, 55B, 55C by passing through the through-holes 55A, 55B, 55C, respectively, of the ink tank 51. It is thereby possible to apply an optimum pressure to the valved ink storing bags and as a result it is possible to feed a stable amount of ink to the ink absorbers 61A, 61B, 61C of the print head 52.

According to the ink jet printer 50 having the above structure in which the ink tank 51 is mounted on the carriage 10 carrying the print head 52, since the valved ink storing bags 60 are set in the ink bag storing chambers 55A, 55B, 55C of the ink tank 51, it is possible to simplify the structure of the ink tank 51 and to permit it not only to store a large amount of ink but also to feed a stable amount of ink to the print head 52.

Figure 6:
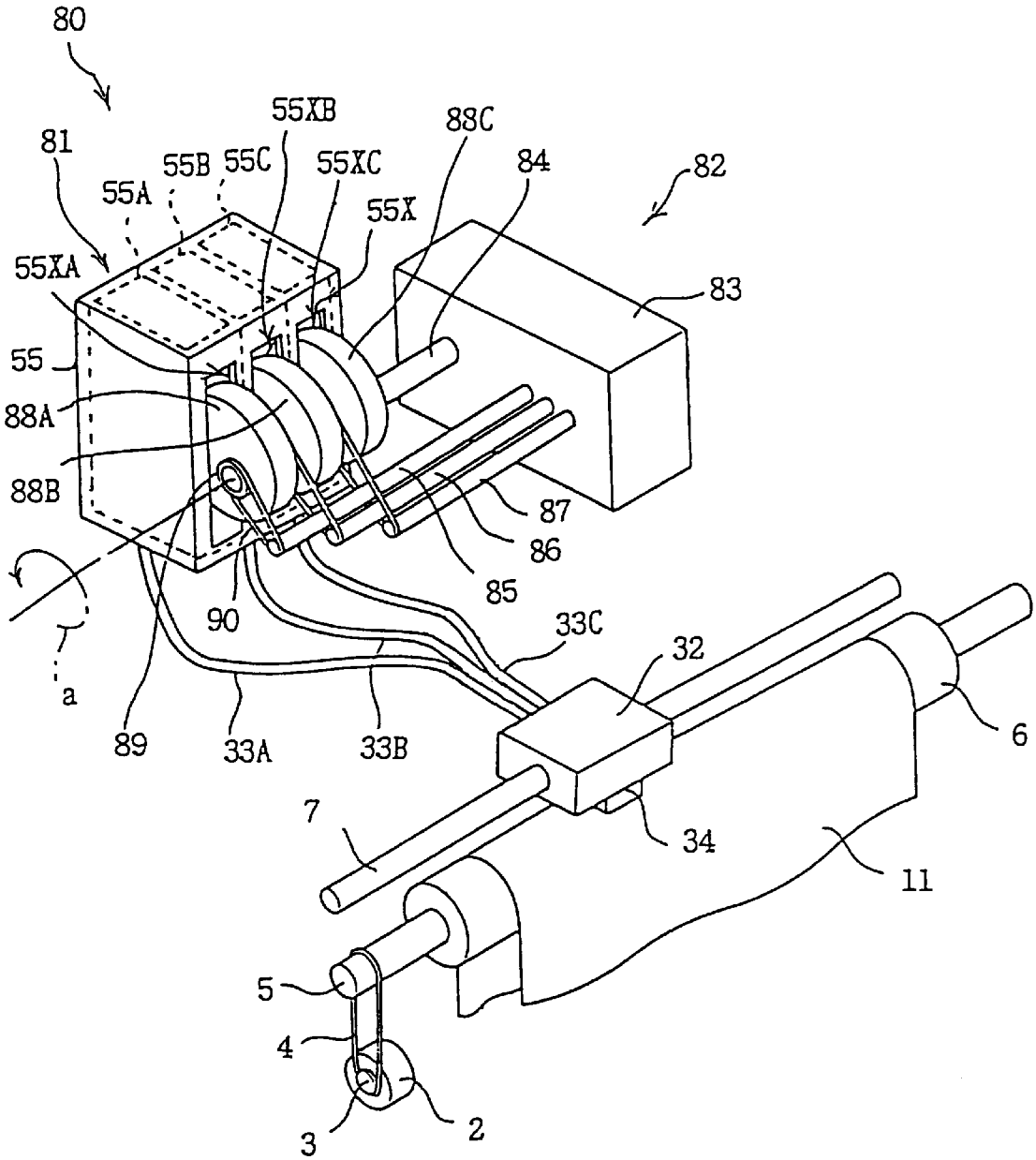
FIG. 6 is a perspective view showing the structure of an ink jet printer according to a second embodiment of the present invention
Figure 25:
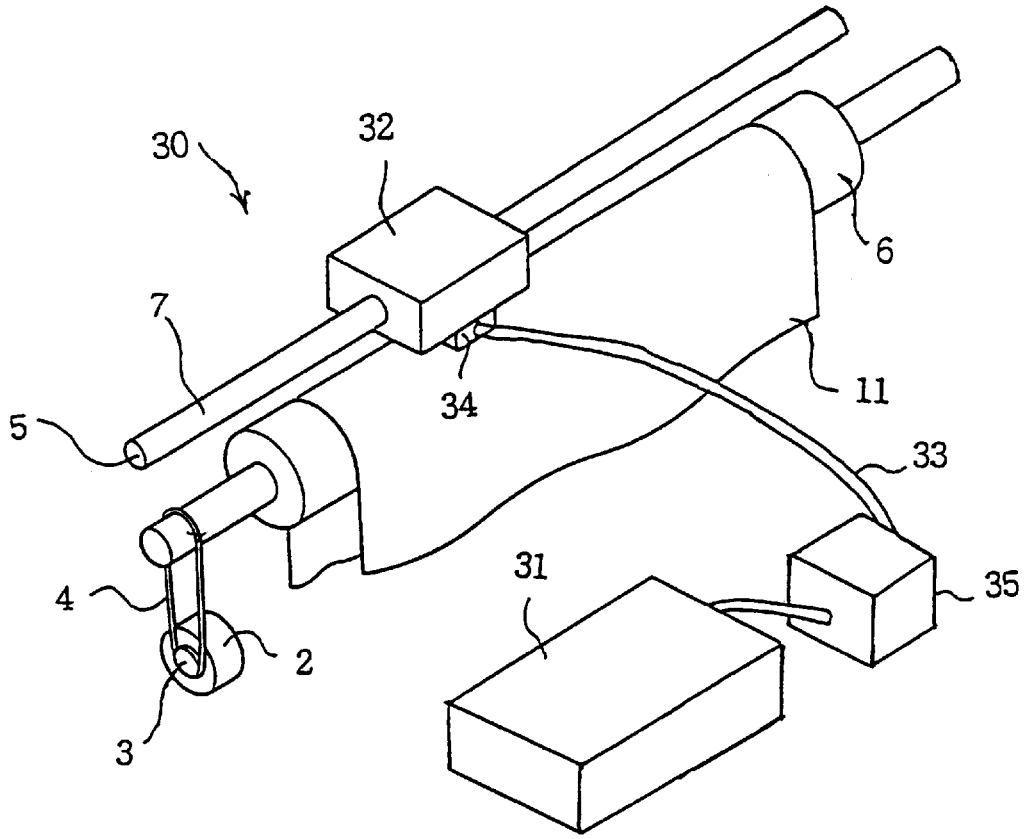
FIG. 25 (PRIOR ART)
FIG. 25 is a perspective view showing the structure of a conventional ink jet printer of the tube type.
Figure 26:
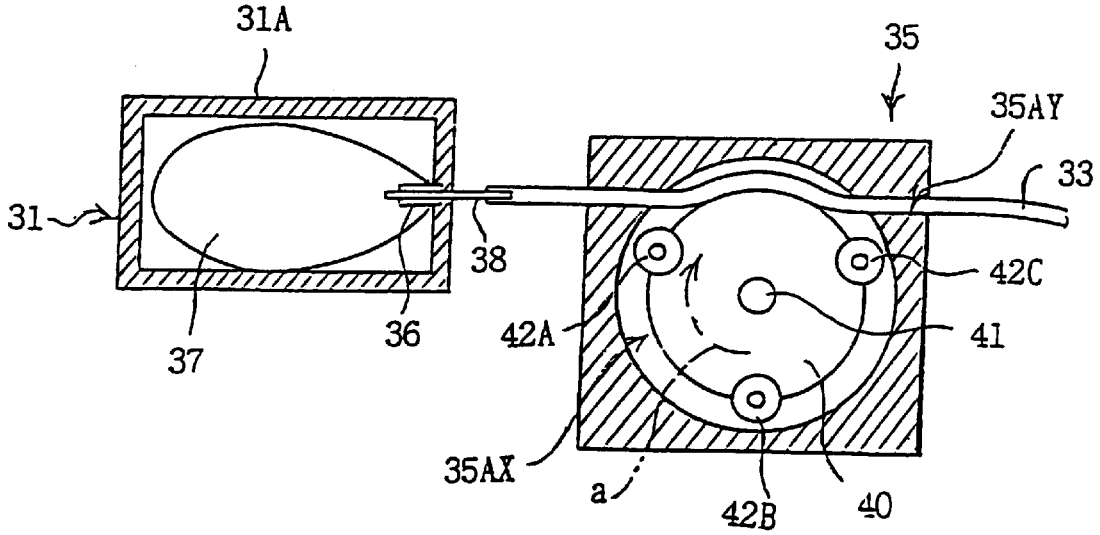
FIG. 26 (PRIOR ART)
FIG. 26 is a partial cross section showing the structures of a conventional ink tank and a tube pump.

In FIG. 6, in which the same numerals are applied to parts corresponding to structures shown in FIGS. 2 and 25, symbol 80 denotes a serial ink jet printer of the tube type to which the present invention is applied. An ink tank 81 has the same case body 55 as that of the ink tank 51 shown in FIG. 2, in which ink tubes 33A, 33B, 33C correspondingly communicate and connect with the ink feed ports 55YA, 55YB, 55YC formed respectively at the bottom ends of the ink bag storing chambers 55A, 55B, 55C in the case body 55.

An ink bag pressing system 82 is provided nearby to ink tank 81 and separately presses the individual valved ink storing bags 60 contained in the ink bag storing chambers 55A, 55B, 55C of the case body 55. In the case of the ink bag pressing system 82, a fixed shaft 84 protrudes to the outside from one side of a driving section 83, and output shafts 85, 86, 87 of three motors, not shown in FIG. 6 but contained in the driving section 83, protrude along the axial direction of the fixed shaft 84 at predetermined intervals.

Three discoid cams 88A, 88B, 88C are rotatably supported on the fixed shaft 84 so as to use the fixed shaft 84 as a cam shaft and are positioned at predetermined intervals along the axial direction of the fixed shaft 84 at positions corresponding to the through-holes 55XA, 55XB, 55XC in the body 55.

Figure 7:
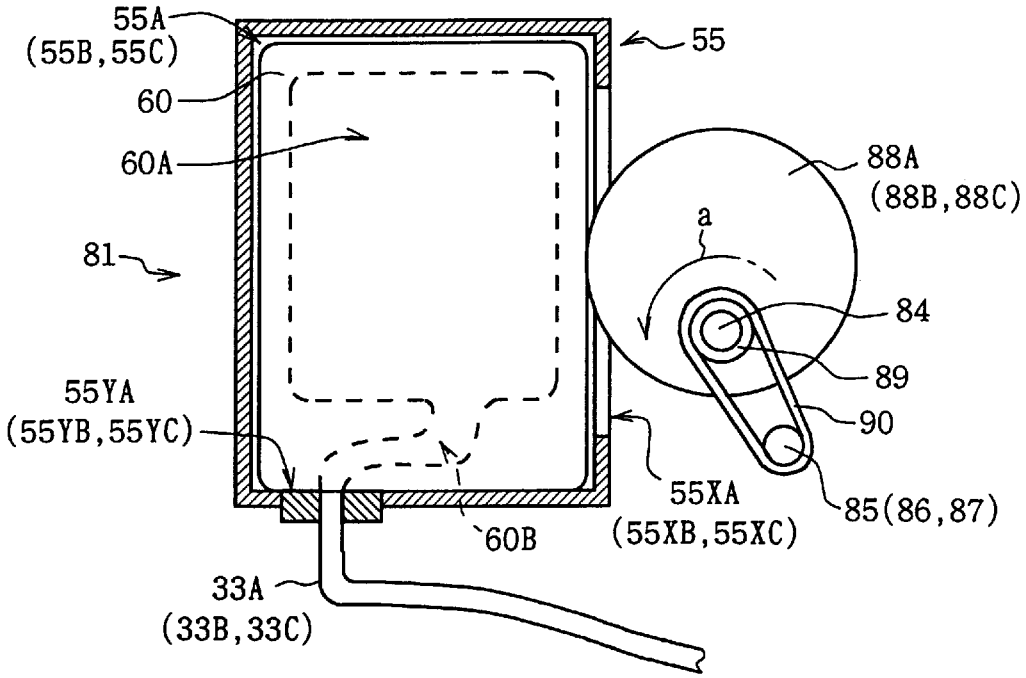
FIG. 7 is a partial cross section showing the structure of an ink tank of the second embodiment.

As shown in FIG. 7 a pulley 89 with the fixed shaft 84 as a rotation center is affixed to each of the three discoid cams 88A, 88B, 88C. One side of a belt 90 is wound on the pulley 89 affixed to the discoid cam 88A and the other end of the belt 90 is wound on the front end of output shaft 85 of the motor contained in the driving section 83. A similar pulley 89 and belt 90 are provided for each of the discoid cams 88B and 88C that cooperate respectively with output shafts 86,87.

Thus, the three motors contained in the driving section 83 are independently driven and controlled, so that the rotation outputs of the motors are supplied to the discoid cams 88A, 88B, 88C, respectively, through the output shafts 85, 86, 87, the belts 90, and the pulleys 89. The discoid cams 88A, 88B, 88C thereby independently rotate and move in the direction of the arrow "a" of FIG. 7 by using the fixed shaft 84 as a cam shaft and fit into the corresponding through-holes 55XA, 55XB, 55XC of the body 55, as shown in FIG. 7.

Figure 8:
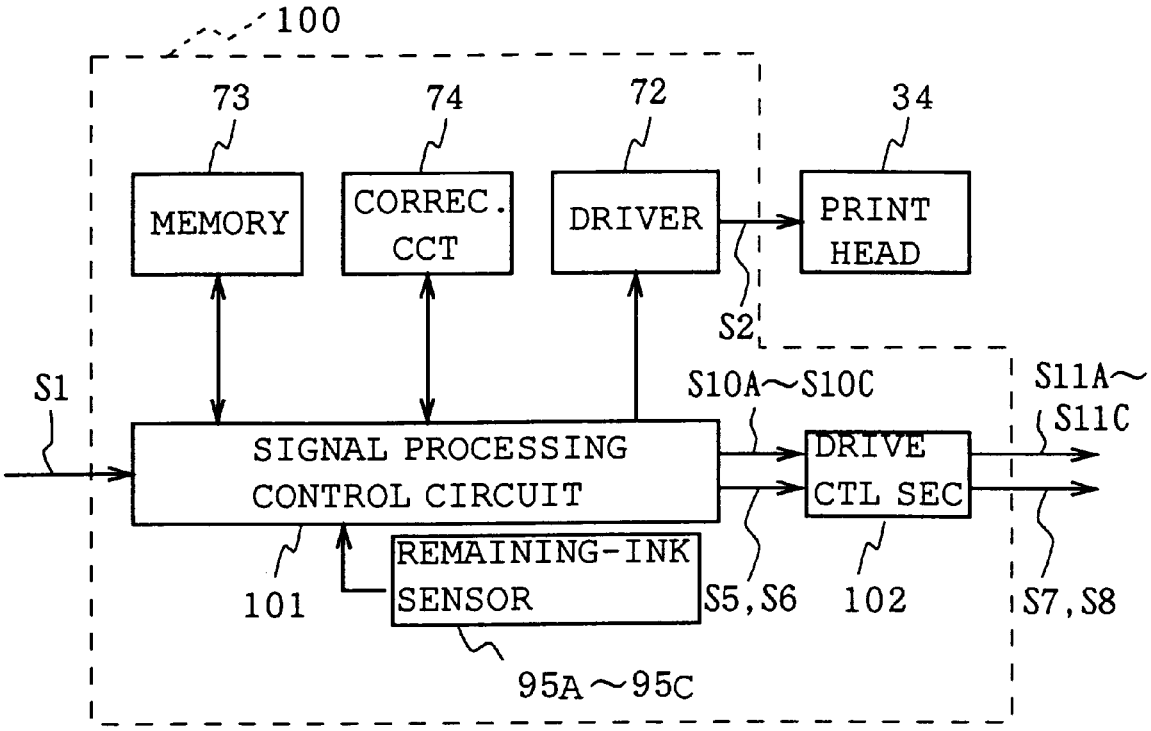
FIG. 8 is a block diagram useful for explaining the structure of a control section of the ink jet printer of the second embodiment.

It should be noted that the remaining-ink sensors 95A, 95B, 95C in a control section 100 of FIG. 8 are respectively placed at the connections of the print head 34 with the ink tubes 33A, 33B, 33C. Each of the remaining-ink sensors 95A, 95B, 95C is used to compute the remaining amount of ink in the respective valved ink storing bag 60 arranged in the ink tank 81 by measuring the respective amounts of the three inks fed to the print head 34 from the ink tank 81. In addition empty bag sensors, not shown, can be employed to signal when a valved ink bag 60 is empty and should be replaced.

FIG. 8, in which the same numerals are applied to parts corresponding to those of FIG. 5, shows the structure of the control section 100 of the serial ink jet printer 80. The control section 100 has a structure almost the same as the control section 70 of the serial ink jet printer 50 of the first embodiment, as shown in FIG. 5.

In FIG. 8, a signal processing control circuit 101 of the control section 100 computes the remaining amounts of the three inks in the valved ink storing bags 60 set in the ink tank 81 in accordance with the measurement results of the amounts of ink fed from the valved ink storing bags 60 by the remaining ink sensors 95A, 95B, 95C, not shown in FIG. 6, and thereafter transmits the computed results to a drive control section 102 as control signals S10A, S10B, S10C. The drive control section 102 computes the rotation values for the three discoid cams 88A, 88B, 88C corresponding to the remaining amounts of ink in the valved ink storing bags 60 in accordance with the control signals S10A, S10B, S10C and thereafter transmits the rotation values to motors, not shown, in the driving section 83 as drive control signals S11A, S11B, S11C.

Each of the motors in the driving section 83 can separately adjust the extent by which the discoid cams 88A, 88B, 88C fit into the through-holes 55XA, 55XB, 55XC by rotating the discoid cams 88A, 88B, 88C in the direction of the arrow "a" in FIGS. 6 and 7 up to a predetermined angle in accordance with drive control signals S11A, S11B, S11C, respectively.

Thus, when the amount of ink remaining in each valved ink storing bag 60 determined by each of the remaining ink sensors 95A, 95B, 95C decreases during operation, the motors in the driving section 83 rotate the discoid cams 88A, 88B, 88C up to a predetermined angle in accordance with the drive control signals S11A, S11B, S11C and thereby apply an optimum pressure to the valved ink storing bags 60 in the ink tank 81, respectively. As a result, it is possible to feed a stable amount of ink to the print head 34.

In the case of the above structure, three valved ink storing bags 60 are first arranged in the ink bag storing chambers 55A, 55B, 55C of the ink tank 81, so that the self-sealing performance of each of the valved ink storing bags 60 functions. When the amount of ink remaining in each valved ink storing bag 60 decreases as the ink jet printer 80 operates, the discoid cams 88A, 88B, 88C pass respectively through the through-holes 55A, 55B, 55C of the ink tank 81 to contact and press the valved ink storing bags 60 arranged in the ink bag storing chambers 55A, 55B, 55C by independently rotating the discoid cams 88A, 88B, 88C up to a predetermined angle.

Thus, it is possible to apply an optimum pressure to each individual valved ink storing bags 60 separately, and it is possible to feed a more stable amount of ink to the print head 34 than in the case of the first embodiment described above.

According to the ink jet printer 80 having the above structure, in which the ink tank 81 is arranged separate and apart from the print head 34 to feed ink to the print head through the tubes 33A, 33B, 33C, three valved ink storing bags 60 having a self-sealing performance are arranged in the ink bag storing chambers 55A, 55B, 55C. Whereby it is possible to simplify the structure of the ink tank 81 so as to store a large amount of ink and constantly to feed a stable amount of ink to the print head, without any ink-feed mechanism such as a tube pump 35 or the like as required in the system of FIG. 25.

Figure 9:
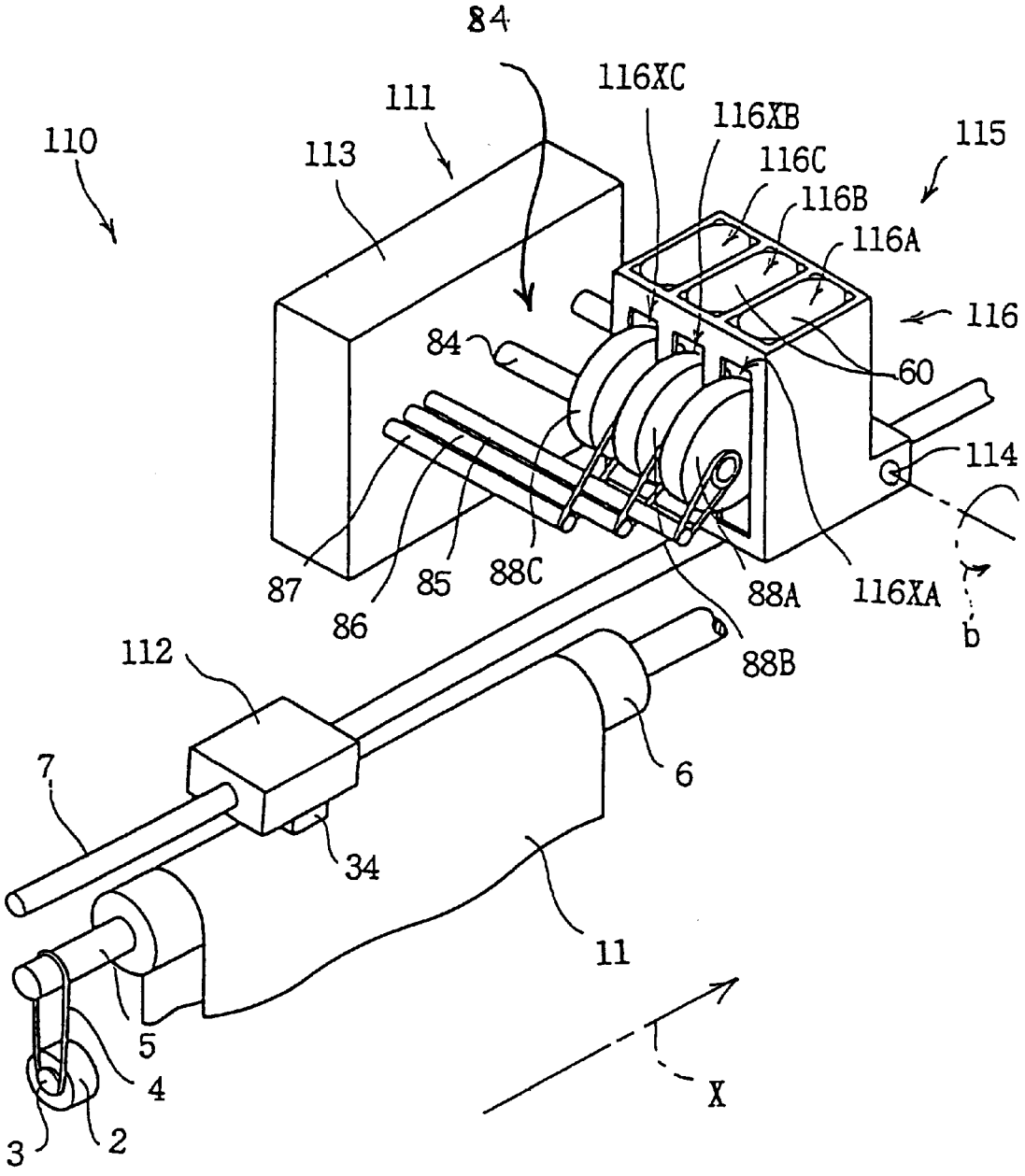
FIG. 9 is a perspective view showing the structure of an ink jet printer according to a third embodiment of the present invention.

In FIG. 9, in which the same numerals are applied to parts corresponding to those of FIG. 6, symbol 110 denotes a serial ink jet printer of the properly united type to which the present invention is applied. In this case, the phrase properly united type denotes a kind of printer in which an ink tank is arranged separately from a print head and ink is replenished to the print head by connecting the ink channel of the print head with that of the ink tank only at predetermined times.

In the serial ink jet printer 110 of FIG. 9, an ink replenishing section 111 is arranged close to the feed screw 7, so that a carriage 112 moving in the direction of the arrow "x" in accordance with the rotation of the feed screw can be selectively connected with the ink replenishing section 111 when the carriage 112 is driven to a predetermined position.

In the ink replenishing section 111, an output shaft 114 of a motor, not shown in FIG. 9, contained in a driving section 113 extends in the axial direction of the fixed shaft 84 and a lower corner of an ink tank 115 is fixed to the output shaft 114. The structure of the ink bag pressing portion 82 shown in FIG. 6 is also present in the embodiment of FIG. 9. The motor and shaft 114 cooperate so that the ink tank 115 can rotate in the direction of the arrow "b", as well as in the direction opposite to the direction of the arrow "b", with the output shaft 114 as the rotation center in accordance with a driving force from the motor.

In the ink tank 115, through-holes 116XA, 116XB, 116XC are formed in one of the side walls of respective ink bag storing chambers 116A, 116B, 116C of a case body 116, so that the discoid cams 88A, 88B, 88C can fit into the through-holes 116XA, 116XB, 116XC respectively in a fashion similarly to the second embodiment.

Figure 10:
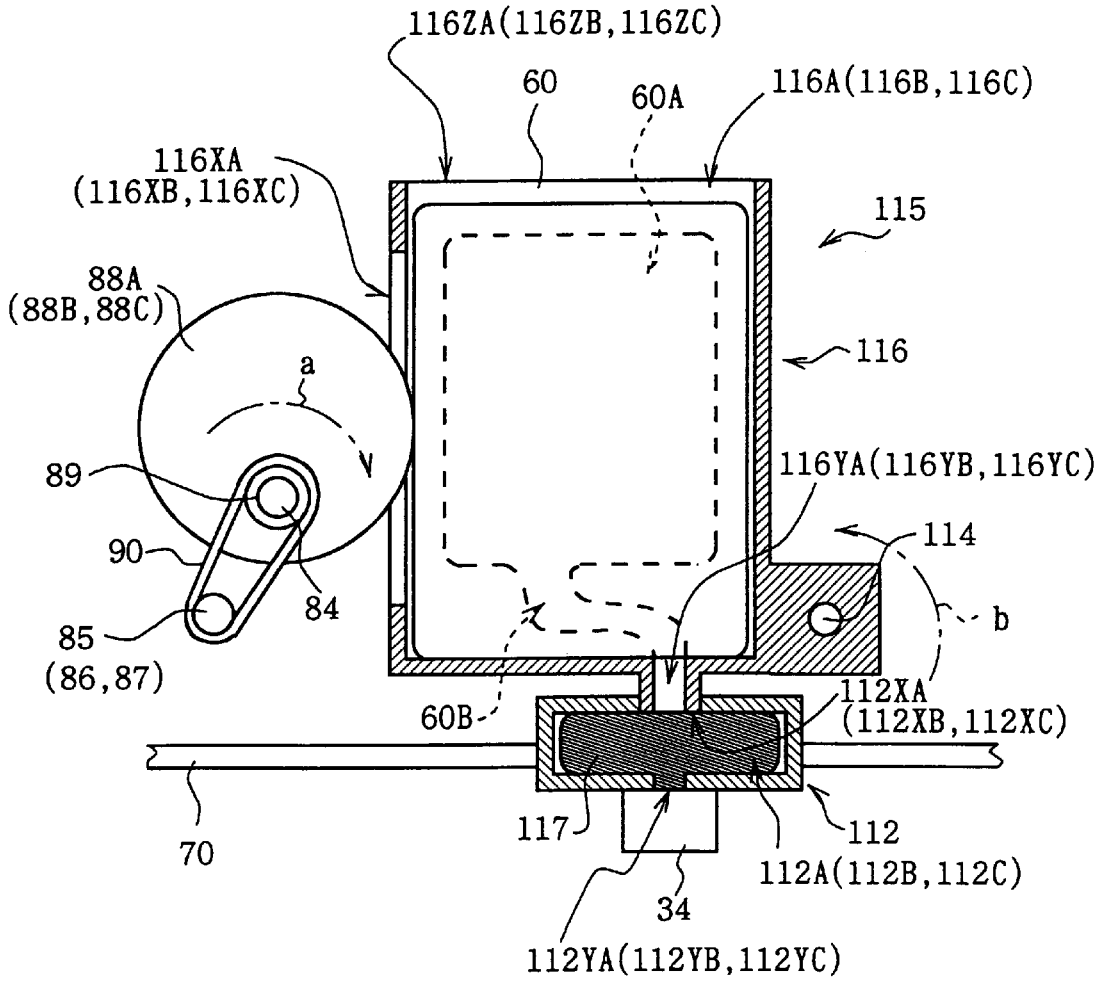
FIG. 10 is a partial cross section showing the structures of an ink tank and a carriage in a first position of the third embodiment.

FIG. 10 is a cross section showing the construction when the ink tank 115 of the ink replenishing section 111 is united with the carriage 112. In this case, in the ink tank 115, ink feed ports 116YA, 116YB, 116YC protrude from the bottom ends of the ink bag storing chambers 116A, 116B, 116C of the case body 116 and openings 116ZA, 116ZB, 116ZC for inserting or removing the valved ink storing bags 60 are formed is the upper ends of the chambers 116A, 116B, 116C.

Hollow portions 112A, 112B, 112C are formed in the carriage 112 and an ink absorber 117 is set in each of the hollow portions 112A, 112B, 112C. Fitting holes 112XA, 112XB, 112XC for receiving the ink feed ports 116AY, 116YB, 116YC and communicating holes 112YA, 112YB, 112YC for feeding ink to the print head 34 are formed in the hollows portions 112A, 112B, 112C, respectively.

It should be noted that remaining-ink sensors, not shown, are arranged at the connections of the print head 34 with the holes 112XA, 112XB, 112XC of the carriage 112, respectively. Each remaining-ink sensor is used to compute the remaining amount of ink in each valved ink storing bag 60 set in the ink tank 115 by measuring the amounts of the three inks fed from the ink tank 115 to the print head 34. The control section, not shown, for the serial ink jet printer 110 of the third embodiment has a structure similar to that of the control section 110 of the serial ink jet printer 90 of the second embodiment. In addition, remaining-ink sensors, not shown, can be arranged at the connections of the print head 34 and the holes 112YA, 112YB, 112YC of the carriage 112 to detect an amount of ink flowing from the ink absorber 117 during printing.

In the case of the above structure, similar to the case of the aforementioned first embodiment, three valved ink storing bags 60 are placed in the ink bag storing chambers 116A, 116B, 116C of the ink tank 115 in such a way so that the self-sealing performance of each of the bags 60 can function. When the ink jet printer 110 of FIG. 9 operates, ink is impregnated in the ink absorber 117 set in each of the hollow portions 112A, 112B, 112C of the carriage 112, and the ink is held without leaking to the print head 34 due to the capillary force of each ink absorber 117.

Figure 11:
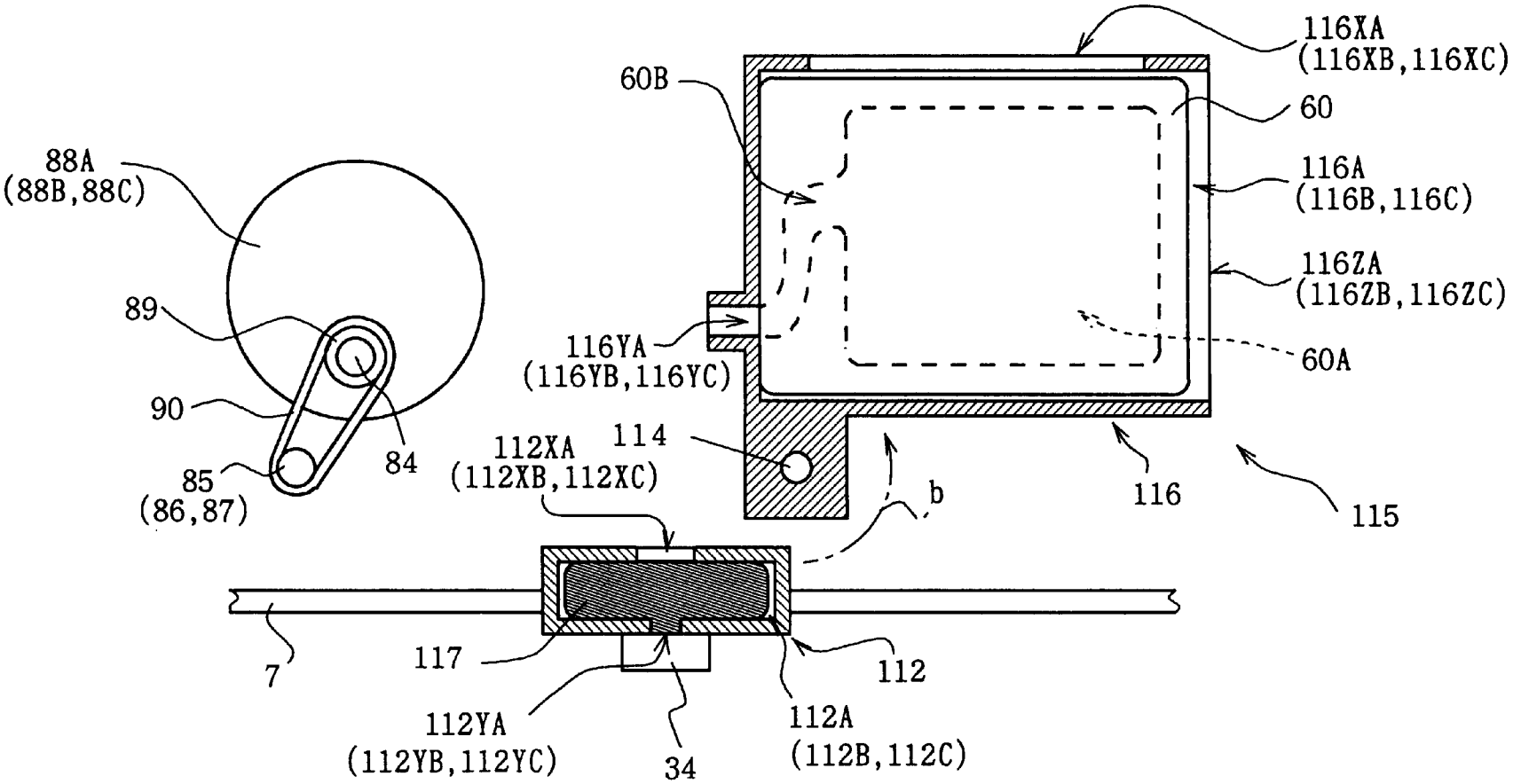
FIG. 11 is a partial cross section showing the structures of the ink tank and the carriage in a second position of the third embodiment.

When the printer 110 operates, the driving section 113 rotates the feed screw 7 to move the carriage 112 to a position close to the ink tank 115 at a time when it is judged that the amount of ink impregnated in each ink absorber 117 in the carriage 112 decreases. This judgement might be base on information obtained from the remaining ink detectors. At that time, the ink tank 115 is kept tilted at a predetermined angle with the shaft 114 as the rotation center, as shown in FIG. 11. Then, the driving section 113 rotates the output shaft 114 in the direction of the arrow "b" through a predetermined angle by driving a motor and thereby fits the ink feed ports 116YA, 116YB, 116YC, protruding respectively from the bottom ends of the ink bag storing chambers 116A, 116B, 116C of the ink tank 115, into the fitting holes 112XA, 112XB, 112XC of the carriage 112 as shown in FIG. 10.

Then, the driving section 113 independently rotates each of the discoid cams 88A, 88B, 88C through a predetermined angle in the direction of the arrow "a", so that the discoid cams 88A, 88B, 88C enter the through-holes 116XA, 116XB, 116XC of the ink tank 115 and contact and press the valved ink storing bags 60 set in the ink bag storing chambers 116A, 116B, 116C.

Thus, it is possible to apply an optimum and individualized pressure to each valved ink storing bag 60 and, therefore, it is possible to feed a stable amount of ink to the print head 34 as in the case of the second embodiment. In this embodiment, no ink tubes, such as 33A, 33B, 33C in FIG. 6, are permanently connected between the ink tank 81 and the print head 34 as in the case of the second embodiment. This makes it possible to simplify the entire structure of the printer and to prevent possible problems such as stopping of the feed of ink to the print head 34 due to air bubbles produced in the ink tubes 33A, 33B, 33C.

According to the ink jet printer 110 having the above structure in which the ink tank 115 is arranged separate and apart from the print head 34 and in which ink is replenished to the print head 34 by connecting the ink channel of the print head 34 with that of the ink tank 115, the valved ink storing bags 60 having the self-sealing capability are placed in the ink bag storing chambers 116A, 116B, 116C of the ink tank 115, so that it is possible to simplify the structure of the ink tank 115, to store a large amount of ink, and to constantly feed a stable amount of ink to the print head 34. In addition, it is possible to reduce the size of the carriage 112 and, as a result, to accelerate the printing operation of the print head 34.

Figure 12:
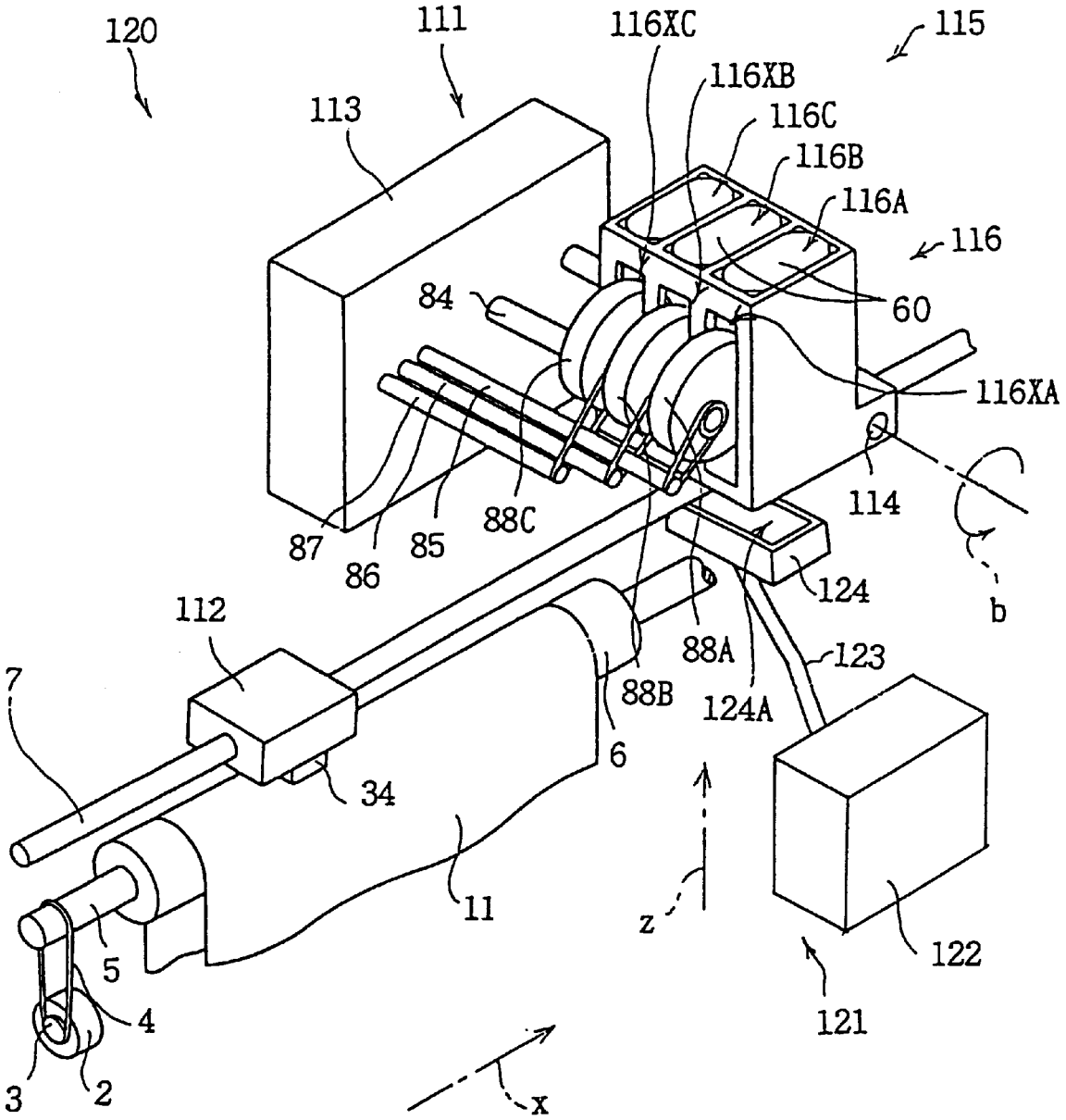
FIG. 12 is a perspective view showing the structure of an ink jet printer according to a fourth embodiment of the present invention.

In FIG. 12, in which the same reference numerals are applied to parts corresponding to those of FIG. 9, symbol

120 denotes a serial ink jet printer of the maintenance station feed type to which the present invention is applied. The phrase maintenance station feed type denotes a system for maintaining the print head in addition to replenishment of ink to the print head of the so-called properly united type. When this serial ink jet printer 120 operates, a head nozzle, not shown, of the print head 34 may become clogged, or dust and dirt may become attached to the head nozzle. Therefore, because a dirty head nozzle may be made to perform fictitious discharge, it is necessary to regularly maintain the print head 34.

Therefore, normally an operation is regularly performed in which the carriage 112 is moved to a predetermined position, which position is hereinafter referred to as the maintenance position, out of the movable range of the print head 34 used for the printing operation, that is, beyond an end of the platen 6, to perform maintenance on the print head 34. Thereafter, the carriage 112 is returned to be within the movable range for the normal printing operation.

Therefore, in the ink jet printer 120 of the maintenance station feed type shown in FIG. 12, a head maintenance system 121 is provided at a predetermined position in the printer, and a head cap 124 that is connected to a vacuum pump 122 in the maintenance system 121 through a tube 123 is vertically moved by a vertical moving means, not shown, in the direction of the arrow "z", or in the direction opposite to the direction of the arrow "z", and is placed in the maintenance position.

The head cap 124 has a concave fitting portion 124A corresponding to the outline of the print head 34, so that the print head 34 can be maintained by enclosing the print head 34 that has been moved to the maintenance position by the fitting portion 124A.

In addition, in the ink jet printer 120 of the maintenance station feed type, the ink tank 115 of the ink replenishing section 111 of the third embodiment can be connected to the carriage 112 set to the maintenance position from the side opposite to the side where the head cap 124 is fitted.

It should be noted that remaining ink sensors, not shown in FIG. 12, can be arranged at the connections between the print head 34 and the communicating holes 112YA, 112YB, 112YC of the carriage 112, respectively, as in the case of the third embodiment.

In the case of the above structure, three types of valved ink storing bags 60 are placed in the ink bag storing chambers 116A, 116B, 116C of the ink tank 115, so that the self-sealing feature of each of the valved ink storing bags 60 functions. When the ink jet printer 120 operates, the ink that is impregnated in the respective ink absorbers 117 set in the hollow portions 112A, 112B, 112C of the carriage 112 is held without leaking to the print head 34 due to the capillary force of each ink absorber 117.

Figure 13:
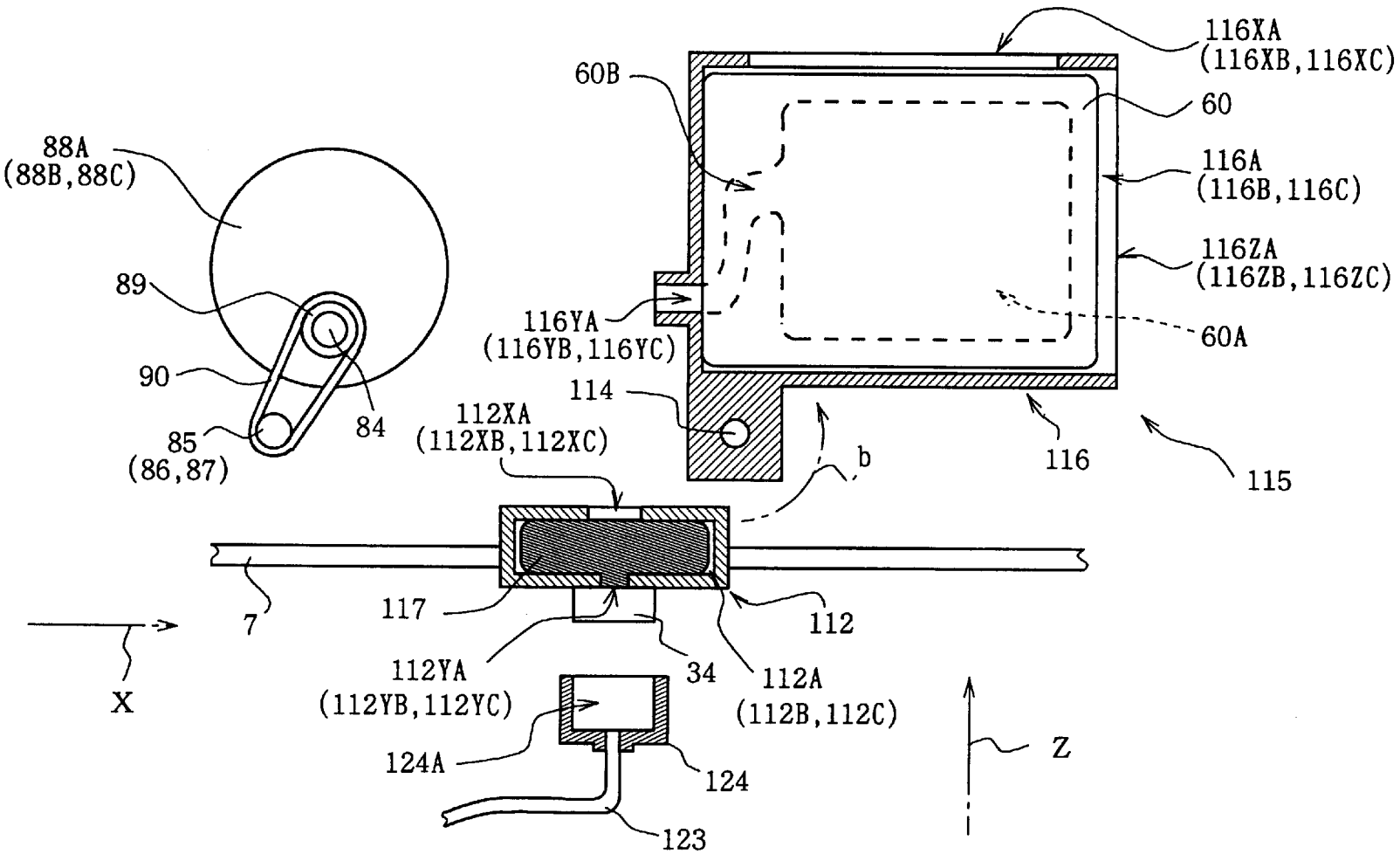
FIG. 13 is a partial cross section useful for explaining an operating state of the fourth embodiment with the print head at the maintenance position.

Upon operation of the printer 120 of FIG. 12, the driving section 113 drives the carriage 112 to the maintenance position, as represented in FIG. 13, by rotating the feed screw 7 at a time when it is judged that the amount of ink impregnated in each ink absorber 117 in the carriage 112 has decreased. In that case, the ink tank 115 is kept tilted at a predetermined angle with the output shaft 114 as the rotation center and the head cap 124 is aligned at a position opposite to the print head 34 by a predetermined distance.

Figure 14:
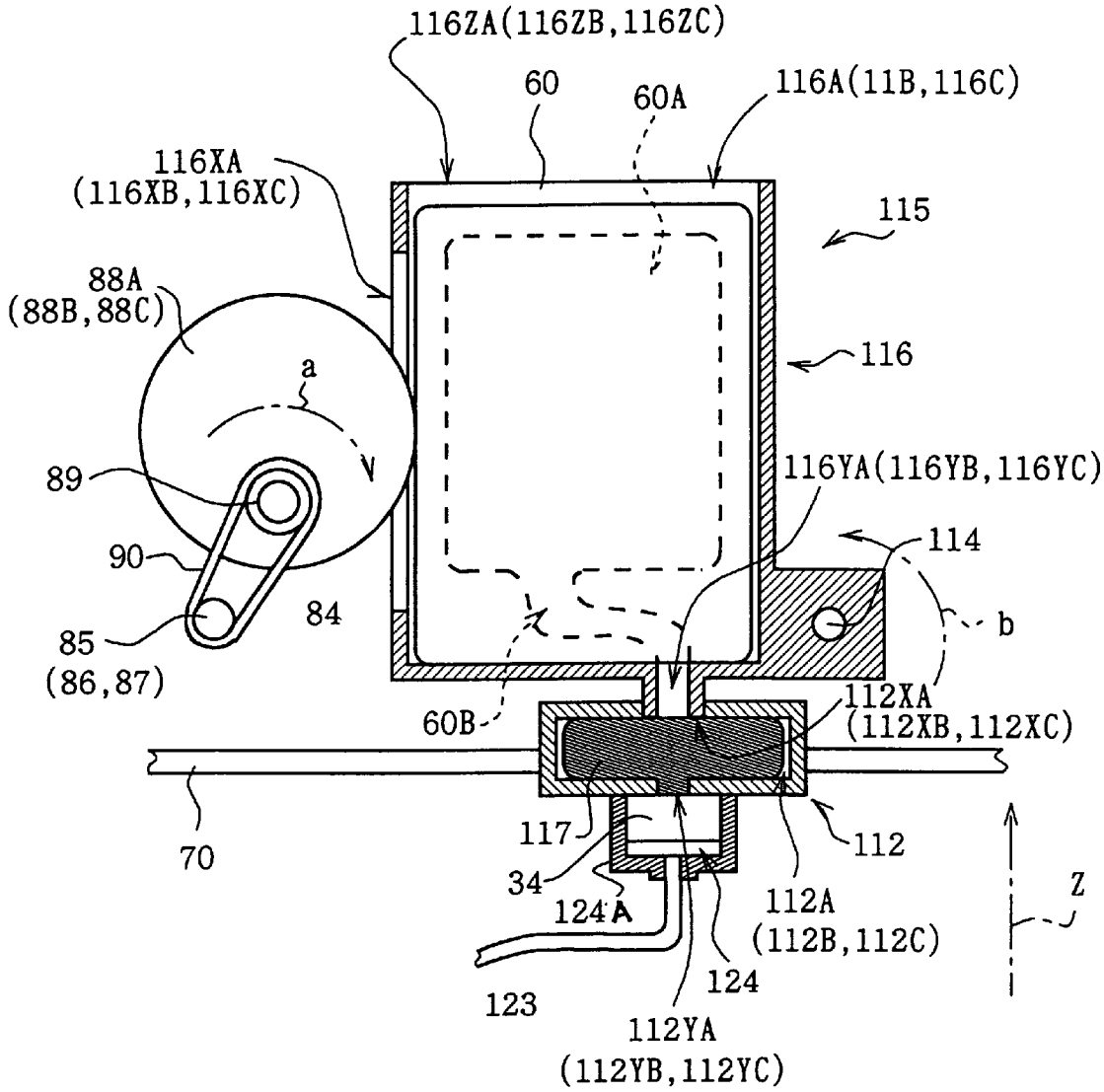
FIG. 14 is a partial cross sectional view useful for explaining an operating state of the fourth embodiment with the print head at the maintenance position.

Under the above state, the driving section 113 causes a motor to rotate the output shaft 114 through a predetermined angle in the direction of the arrow "b", so that the ink feed portions 116YA, 116YB, 116YC that respectively protrude from the bottom ends of the ink bag storing chambers 116A, 116B, 116C of the ink tank 115 are fitted into the fitting holes 112XA, 112XB, 112XC of the carriage 112, as shown in FIG. 14. The vertical moving means, not shown, fits the fitting portion 124A of the head cap 124 to the print head 34 and encloses the print head 34 by raising the head cap 124 in the direction of the arrow "z", as shown in FIG. 14.

Then, the driving section 113 independently rotates the individual discoid cams 88A, 88B, 88C through a predetermined angle in the direction of the arrow "a", so that the discoid cams 88A, 88B, 88C enter the through-holes 116XA, 116XB, 116XC of the ink tank 115 to contact and press the valved ink storing bags 60 arranged in the ink bag storing chambers 116A, 116B, 116C, respectively. In addition, the vacuum pump 112, shown in FIG. 12, applies a predetermined negative pressure to the fitting portion 124A of the head cap 124 through the tube 123.

Thus, it is possible to feed a stable amount of ink to the print head 34 by separately applying an optimum pressure to the valved ink storing bags 60 and at the same time to remove dust from a clogged head nozzle of the print head 34 by a vacuum through the tube 123.

According to the ink jet printer 120 having the above structure in which the ink tank 115 is arranged separate and apart from the print head 34 to replenish ink to the print head 34 by connecting the ink channel of the print head 34 with that of the ink tank 115 at a predetermined time, the valved ink storing bags 60 having a self-sealing performance are arranged in the ink bag storing chambers 116A, 116B, 116C of the ink tank 115, and the print head 34 is maintained simultaneously with the operation of supplying ink to the print head 34, and it is thereby possible to simplify the structure of the ink tank 115, to store a large amount of ink, and to constantly feed a stable amount of ink to the print head 34, similar to the case of the third embodiment described hereinabove. This makes it possible to reduce the size of the carriage 112 and as a result to accelerate the printing operation of the print head 34. Furthermore, it is possible to further improve the printing operation by supplying ink to the print head 34 simultaneously with the maintenance of the print head 34.

Figure 15:
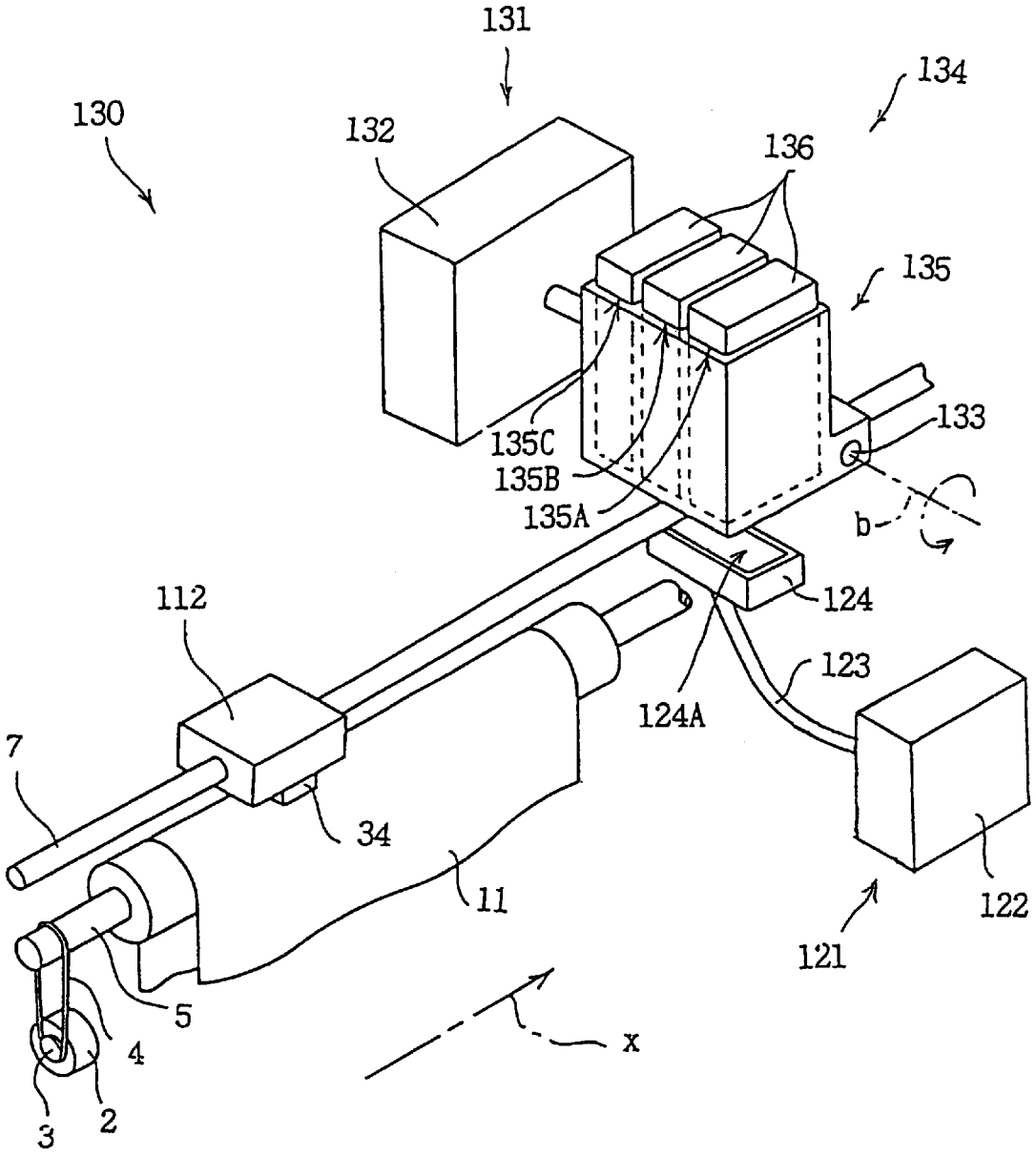
FIG. 15 is a perspective view showing the structure of an ink jet printer according to a fifth embodiment of the present invention.

In FIG. 15, in which the same reference numerals are applied to parts corresponding to those of FIG. 12, symbol 130 denotes a serial ink jet printer of the maintenance station feed type to which the present invention is applied, which has the same structure as the serial ink jet printer 120 of the third embodiment, except for the structure of an ink replenishing section 131.

Figure 16:
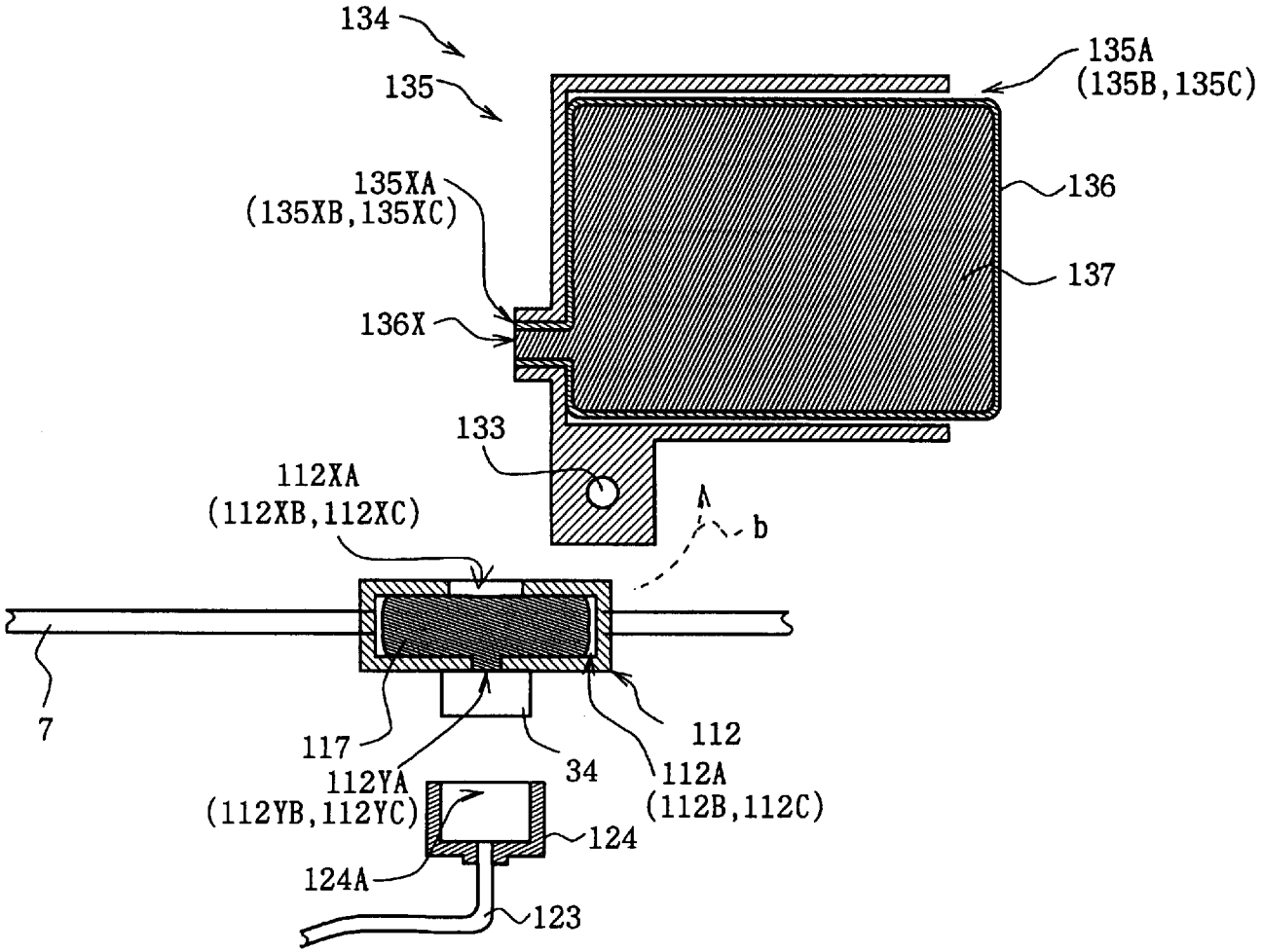
FIG. 16 is a partial cross section useful for explaining an operating state of the fifth embodiment with the print head at the maintenance position.

The ink replenishing section 131 has a construction in which the bottom end of an ink tank 134 is connected to an output shaft 133 of a motor, not shown, mounted in a driving section 132. In the ink tank 134, ink vessel storing chambers 135A, 135B, 135C whose upper sides are opened are formed in a case body 135 and, as shown in FIG. 16, ink feed portions 135XA, 135XB, 135XC for feeding ink to the print head 34 are respectively formed at the bottom ends of the ink vessel storing chambers 135A, 135B, 135C. An ink storing vessel 136 corresponding to inks with colors different from each other is contained in each of the ink vessel storing chambers 135A, 135B, 135C.

In this case, the ink storing vessel 136 comprises a closed vessel in which the ink absorber 137 is compressed and installed as shown in FIG. 16, and a plurality of air introducing holes, not shown, for introducing air into the vessel 136 are formed at the top end and a protruding communicating port 136X into which the ink absorber 137 extends is formed at the bottom end.

By producing meniscuses inside of the ink absorber 137 at the air introducing hole side a capillary force is produced in the ink absorber 137, a predetermined negative pressure is produced in the ink storing vessel 136. Therefore, the ink impregnated in the ink absorber 137 is held by the ink absorber 137 without leaking to the outside from the protruding communicating port 136X.

Figure 17:
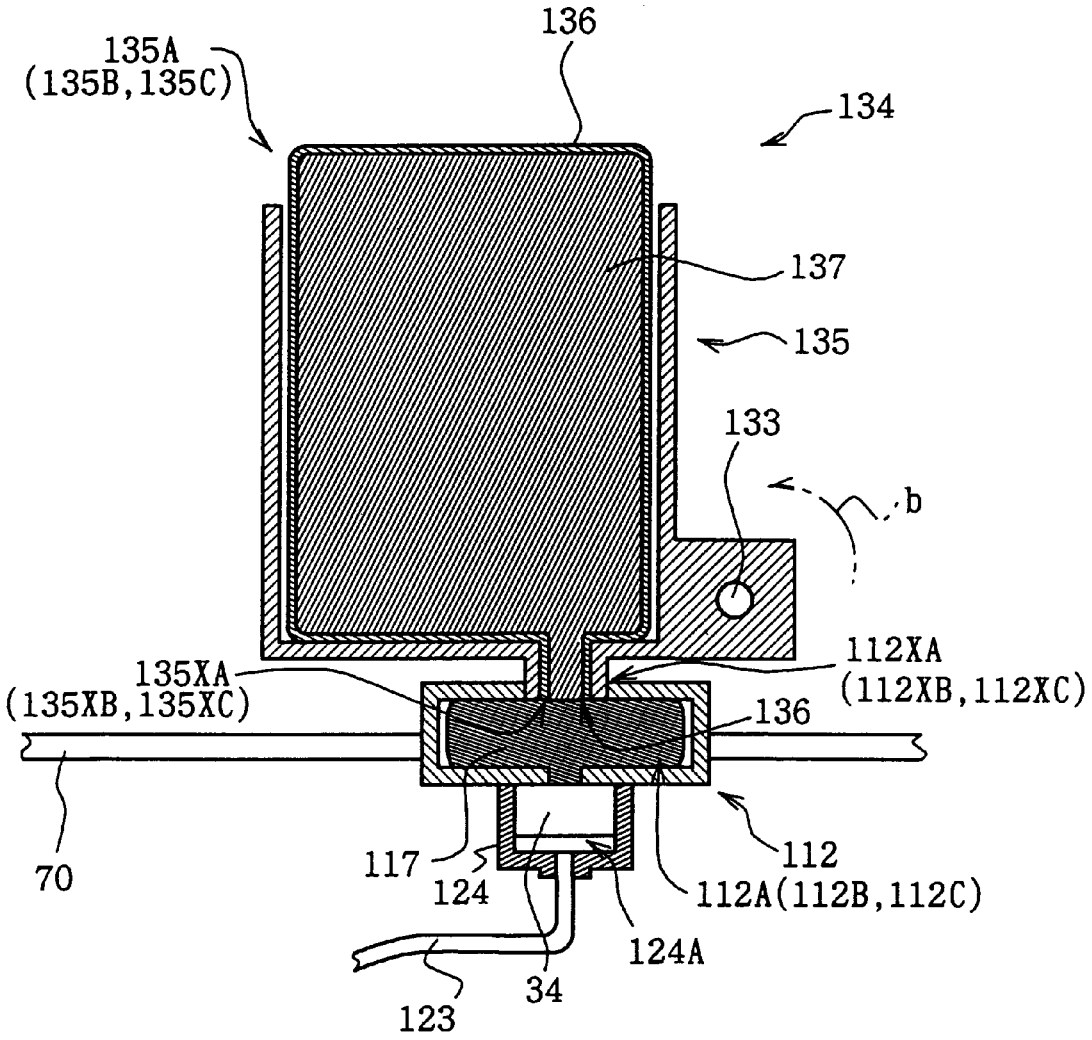
FIG. 17 is a partial cross section useful for explaining an operating state of the fifth embodiment with the print head at the maintenance position.

Then, when an ink storing vessel 136 is placed in each of the ink vessel storing chambers 135A, 135B, 135C, as shown in FIG. 16, the protruding communicating portion 136X of the ink storing vessel 136 fits into the ink feed ports 135XA, 135XB, 135XC of the ink vessel storing chambers 135A, 135B, 135C, respectively, as shown in FIG. 17.

In that case, the material of the ink absorber 137 is specifically selected so that its foaming rate is higher than that of the ink absorber 117 in the carriage 112. This results in the ink absorber 137 having a capillary force smaller than that of the ink absorber 117, that is, when both absorbers 137 and 117 contact each other while being supplied with ink, the ink is unilaterally fed from the ink absorber 137 to the ink absorber 117 until the capillary forces of both absorbers are equalized each other.

A remaining-ink sensor, not shown, is arranged at each of the connections between the print head 34 and the communicating holes 112YA, 112YB, 112YC of the carriage 112, respectively, similar to the case of the third embodiment.

In the case of the above structure, three of the ink storing vessels 136 are first placed in the ink vessel storing chambers 135A, 135B, 135C of the ink tank 134, so that the protruding communicating ports 136X can fit into their corresponding ink feed ports 135XA, 135XB, 135XC.

When the ink jet printer 130 operates, ink is impregnated in the ink absorbers 117 set in the hollow portions 112A, 112B, 112C of the carriage 112 and held by the capillary force of each ink absorber 117 without leaking to the print 34. The ink impregnated in the ink absorber 137 in the ink storing vessel 136 is held without leaking to the outside from the protruding communicating port 136X.

During operation, the driving section 132 moves the carriage 112 to the maintenance position, as shown in FIG. 16, by rotating the feed screw 7 at a time when it is judged that the ink impregnated in each ink absorber 117 in the carriage 112 has decreased. At that time, the ink tank 134 is kept tilted at a predetermined angle with the output shaft 133 as the rotation center, and the head cap 124 is aligned while keeping a predetermined distance at a position opposite to the print head 34.

Then, the driving section 132 drives a motor to rotate the output shaft 133 through a predetermined angle In the direction of the arrow "b" and thereby fits the ink feed ports 135XA, 135XB, 135XC protruding respectively at the bottom ends of the ink vessel storing chambers 135A, 135B, 135C of the ink tank 134 into the fitting holes 112XA, 112XB, 112XC of the carriage 112, as shown in FIG. 17. The vertical-moving means raises the head cap 124 in the direction of the arrow "z" and thereby encloses the print head 34 by fitting the fitting portion 124A of the head cap 124 to the print head 34, as shown in FIG. 17.

In this case, the ink absorbers 137 arranged at the protruding communicating ports 136X of the ink storing vessels 136 contact the ink absorbers 117 exposed from the fitting holes 112XA, 112XB, 112XC of the carriage 112. Ink is thereby unidirectionally and automatically fed from the ink absorber 137 to the ink absorber 117 due to the difference between the capillary forces of the ink absorbers 137 and the 117 until the capillary forces of the absorbers 137 and 117 are equalized with each other.

Thus, it is possible to feed a stable amount of ink to the print head 34 by adjusting the capillary force of the ink absorber 137 relative to the ink absorber 117 for each ink storing vessel 136, for example, by selecting the foaming rates of the absorbing material, while at the removing dust from a clogged head nozzle of the print head 34 by means of suction.

According to the ink jet printer 130 having the above structure, in which the ink tank 134 is arranged separate and apart from the print head 34 to replenish ink to the print head 34 by connecting the ink channel of the print head 34 with the ink tank 134 at a predetermined time, it is possible to simplify the structure of the ink tank 134, to store a large amount of ink, and to constantly feed a stable amount of ink to the print head 34 similarly to the effects of the fourth embodiment described above, because the ink storing vessel 136 includes an ink absorber 137 having a capillary force smaller than that of the ink absorber 117 that is arranged in the ink vessel storing chambers 135A, 135B, 135C of the ink tank 134 and dust is removed from the head nozzle of the print head 34 simultaneously with the supplying of ink to the print head 34.

In addition, it is possible to decrease the size of the carriage 112 and thereby accelerate the printing operation of the print head 34. Furthermore, it is possible to further improve the printing operation by feeding ink to the print head 34 simultaneously with the maintenance of the print head 34.

Furthermore, since ink is fed to the print head 34 by using the difference between the capillary forces of the ink absorbers 117 and 137, the mechanical system for applying pressure to the valved ink bags, such as the discoid cams 88A, 88B, 88C used in the fourth embodiment, is unnecessary and, thus, the entire structure of the printer can be greatly simplified.

Figure 18:
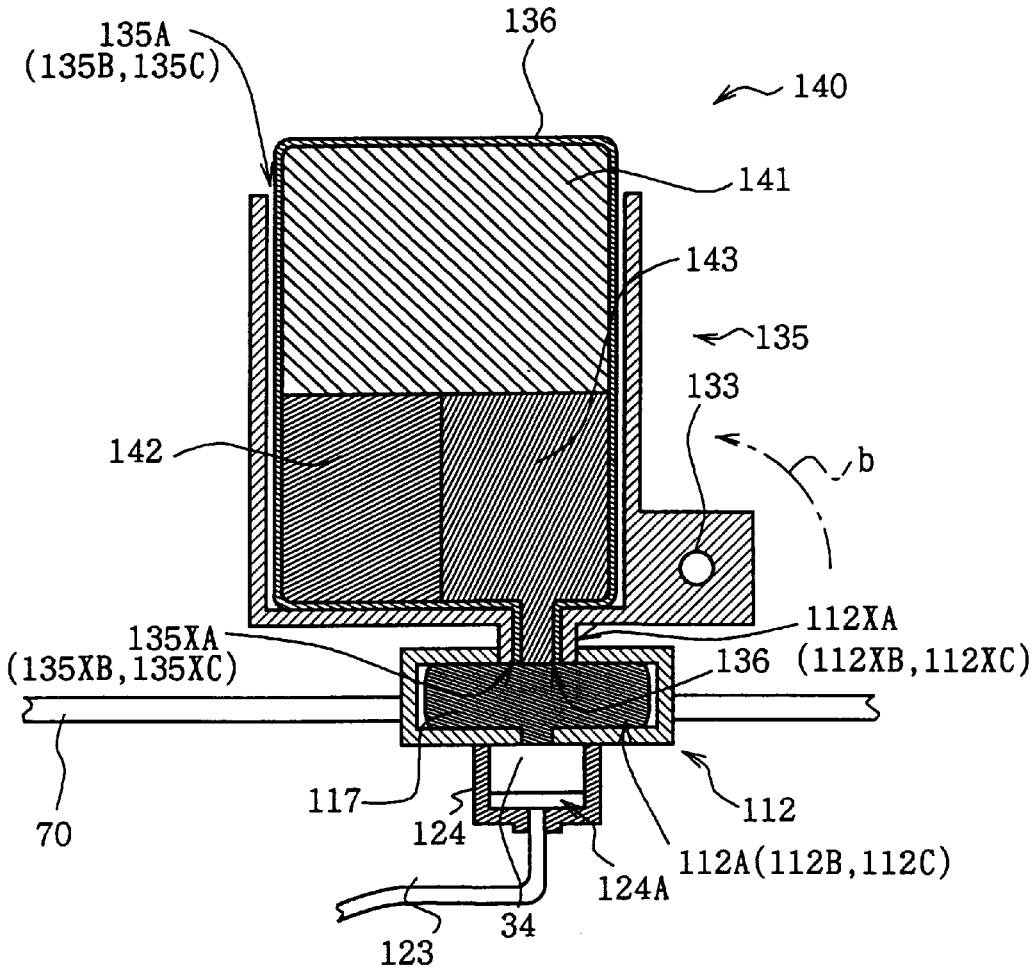
FIG. 18 is a partial cross section useful for explaining an operating state of a sixth embodiment with the print head at the maintenance position.

In FIG. 18, in which the same reference numerals are applied to parts corresponding to those of FIG. 17, an ink tank 140 has the same structure as the ink tank 134 of FIG. 17 except the material of the ink absorbers 141, 142, 143 arranged in the ink storing vessel 136 is different. More specifically, three kinds of ink absorbers 141, 142, 143 having respective foaming rates that differ from each other are placed in the ink storing vessel 136 by being compressed so as to be in contact with each other, as shown in FIG. 18. In this case, the material is specifically selected so that the foaming rate of the ink absorber 141 in the ink storing vessel 136 at the air introducing hole side has a maximum foaming rate and the ink absorber 143 at the protruded communicating port 136X side has a minimum foaming rate. This means that the ink absorber 141 has the smallest capillary force and the ink absorber 143 has the largest capillary force.

Thus, it is necessary to select the material of the ink absorbers 141, 142, 143 and to select the allotment of the ink absorbers 141, 142, 143 in the ink storing vessel 136, so that the ink impregnated in the ink absorber 143 in the ink storing vessel 136 is held without leaking to the outside, for example, from the protruding communicating port 136XA of the ink storing vessel 136.

As in the case of the fifth embodiment described above, the material of the ink absorber 143 is specifically selected so that the ink absorber 117 in the carriage 112 has a capillary force larger than that of the ink absorber 143 in the ink storing vessel 136. Thus, when the ink tank assembly 140 unites with the carriage 112, the ink absorber 143 at the protruded communicating ports 136XA, 136XB, 136XC contacts the ink absorber 117 exposed from each of the fitting holes 112XA, 112XB, 112XC of the carriage 112. Therefore, ink is directionally and automatically fed from the ink absorber 143 to the ink absorber 117 until the capillary forces of the ink absorber 143 and the ink absorber 117 are equalized with each other.

In the above structure, ink is previously impregnated in the ink absorbers 141, 142, 143 in each ink storing vessel 136 of the ink tank assembly 140. Since the capillary force of the ink absorber 141 of the ink storing vessel 136 at the air introducing hole side is smaller than those of the ink absorbers 142 and 143, however, ink is unilaterally fed from the ink absorber 141 to the ink absorbers 142 and 143.

Then, since the capillary force of the ink absorber 142 is smaller than that of the ink absorber 143 at the protruded communicating port 136XA, for example, of the ink storing vessel 136, ink is unilaterally fed from the ink absorber 142 to the ink absorber 143. As a result, all of the ink impregnated in the ink absorbers 141, 142, 143 in the ink storing vessel 136 is ultimately fed to the ink absorber 143 at the protruded communicating port 136XA. Thus, it is possible to efficiently feed ink to the protruding communicating ports 136X, 136B, 136C independently of the size of the ink storing vessel 136 or the position of the protruded communicating ports 136XA, 136XB, 136XC of the ink storing vessel 136.

According to the ink tank 140 having the above structure, in which the capillary force of the ink absorber 143 of the ink storing vessel 136 at the protruded communicating ports 136XA, 136XB, 136XC is maximized, it is possible to constantly feed a stable amount of ink to the print head 34 independently of the size of the ink storing vessel 136 or the position of the protruding communicating ports 136XA, 136XB, 136XC of the ink storing vessel 136, in addition to the improved effects of the fifth embodiment described above.

In the above embodiments, apparatus is described in which the present invention is applied to the serial ink jet printers 30, 50, 80, 110, 120, and 130, however, the present invention is not restricted only to those printers and it is also possible to apply the present invention to a line ink jet printer and a drum ink jet printer.

Additionally, in the second, third, and fourth embodiments, apparatus is described as shown in FIGS. 7, 10, and 14, in which the through-holes 55XA, 55XB, 55XC, 116XA, 116XB, 116XC are formed only at one side of the case body 55, 116, of the ink tank 81, 115 and pressure is applied by inserting and rotating discoid cams 88A, 88B, 88C serving as external-pressure applying means corresponding to the through-holes 55XA, 55XB, 55XC, 116XA, 116XB, 116XC, respectively. The present invention is not restricted to the above case, however, and it is also possible to use a cam mechanism such as a triangular cam or an oscillating cam or to use a crank mechanism as the external-pressure applying means instead of the discoid cams 88A, 88B, 88C. In short, it is possible to widely use various types of mechanisms as the external-pressure applying means as long as the mechanisms can apply a suitable pressure to the valved ink bags 60 by fitting them into the through-holes 55XA, 55XB, 55XC, 116XA, 116XB, 116XC.

Figure 19:
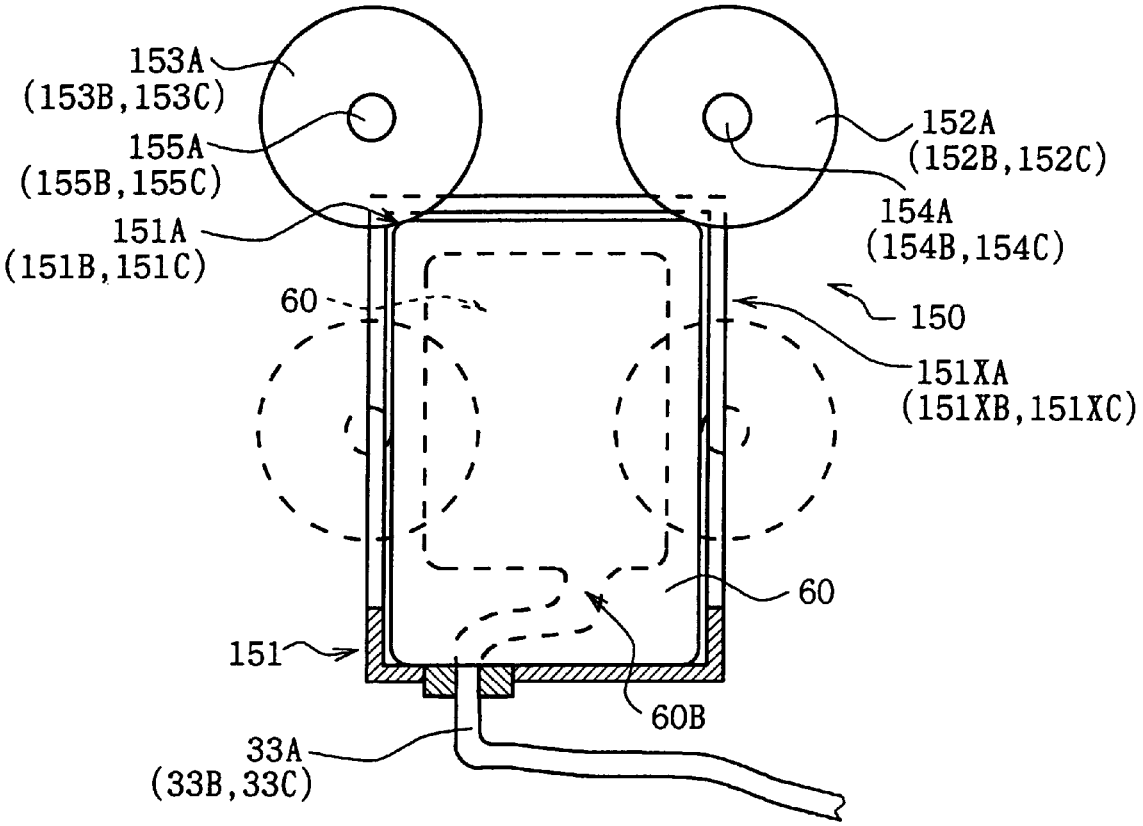
FIG. 19 is a partial cross section showing the structure of an ink tank according to another embodiment of the present invention.

In the second, third, and fourth embodiments, apparatus case is described as shown in FIGS. 7, 10, and 14, in which the through-holes 55XA, 55XB, 55XC, 116XA, 116XB, 116XC are formed only at one side of the case body 55, 116 of the ink tank 81, 115. The present invention is not restricted to the above case, however, and it is also possible to form notched grooves 151XA, 151XB, 151XC with a predetermined width along the both sides and the top of a case body 151 of an ink tank 150, as shown in FIG. 19, in which the same reference numerals are applied to parts corresponding to those of FIG. 7.

In this case, three pairs of rollers 152A, 152B, 152C and 153A, 153B, 153C, respectively, are supported with respective rotary shafts 154A, 154B, 154C and 155A, 155B, 155C as rotation centers and are arranged corresponding to ink bag storing chambers 151A, 151B, 151C as the external-pressure applying means. Each pair of rollers 152A, 152B, 152C and 153A, 153B, 153C can two-dimensionally move on both sides of the case body 151 along notched grooves 151XA, 151XB, 151XC formed on both sides of the case body 151.

Thus, three pairs of rollers 152A, 152B, 152C and 153A, 153B, 153C press the three valved ink storing bags 60 stored in their corresponding ink bag storing chambers 151A, 151B, 151C while rotating and traveling vertically, so that it is possible to discharge ink from the valved ink storing bags 60 to the outside until the valved ink storing bags 60 become empty. As a result, it is possible to constantly feed a fixed amount of ink to a print head independently of the amount of ink remaining in the valved ink storing bags 60.

Figure 3:
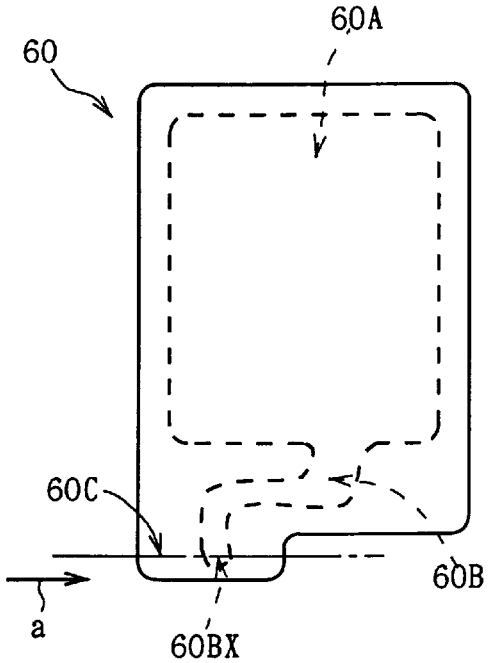
FIGS. 3(A) and 3(B) are elevational views showing the structure of a valved ink storing bag according to the present invention.
Figure 3:
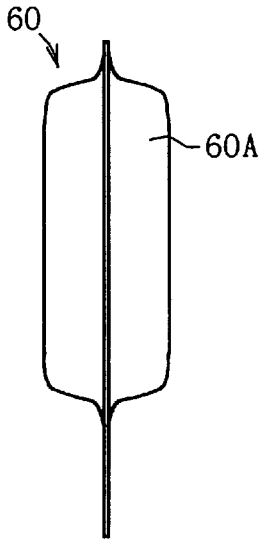

In the above embodiments, apparatus is described in which external pressure is applied to the ink injecting portion 60A of the valved ink storing bag 60, as shown in FIGS. 3(*a*) and 3(B), so as to press the side of the welded portion of the valve-provided ink storing bag 60 from one side or to hold it from the both sides. The present invention is not restricted to the above case, however, and it is also possible to press each film plane of the ink injecting portion 60A of the valved ink storing bag 60 from one side or hold it from the both sides. In short, it is possible to apply an external pressure to the ink injecting portion 60A of the valved ink storing bag 60 from any direction.

Furthermore, in the first embodiment, apparatus is described in which the case body 55 is arranged separately from the carriage 10, as shown in FIG. 2. The present invention is not restricted to the above case, however, and it is also possible to form the case body 55 and the carriage 10 unitarily.

Furthermore, in the above embodiments, apparatus is described in which the remaining ink sensors 62A, 62B, 62C, 95A, 95B, 95C are constituted so as to detect the remaining amount of ink in the valved ink storing bag 60. The present invention s not restricted to the above case, however, and it is also possible to detect whether each valved ink storing bag 60 is filled with ink in addition to a remaining amount of ink. In such case, it is necessary to regularly feed a predetermined amount of ink into each valved ink storing bag 60. Additionally, it is also possible to use the remaining ink sensors 62A, 62B, 62C, 95A, 95B, 95C as sensors for the home position or at the maintenance station.

Furthermore, in the above embodiments, apparatus is described in which the valved ink storing bag 60 is formed by sticking two polyester films together by means of welding. The present invention is not restricted to the above case, however, and it is also possible to use for the material for the valved storing bag 60 not only polyester but also polyethylene, polypropylene, vinyl chloride, polyurethane, and polystyrene, and it is possible to use a block copolymer containing at least one of the above materials. In this manner, after using the valved ink storing bag 60, it is possible to recycle the valved ink storing bag 60 as another material by converting it into oil and to prevent environmental contamination. Moreover, use of a biodegradational polymer is very effective as an environmental measure because the used valved ink storing bag 60 is easily decomposed in the earth.

Furthermore, in the above embodiments, apparatus is described in which a cellular body, such as urethane foam made of a foaming material, is applied as the ink absorbers 21, 61A, 61B, 61C, 117, 137, and 141, 142, 143. The present invention is not restricted to the above case, however, and it is also possible to use a coagulated fiber, such as felt, in addition to the cellular body. In this case, when a foaming material is used for each ink absorber, the capillary force is adjusted by selecting the foaming rate, whereas when using coagulated fiber as the ink absorber, the capillary force is adjusted by selecting the density of the fiber.

Furthermore, in the above sixth embodiment, apparatus is described in which the shapes of the case body 135 of the ink tank 140 and the ink storing vessel 136 corresponding to the case body 135 are formed so as to be relatively longitudinally elongated, as shown in FIG. 18. The present invention is not restricted to the above case, however, and it is also possible to apply the present invention even to a case in which the shapes of the case body 161 of the ink tank 160 and the ink storing vessel 162 corresponding to the case body 161 are formed so as to be relatively laterally elongated, as shown in FIG. 20.

Figure 20:
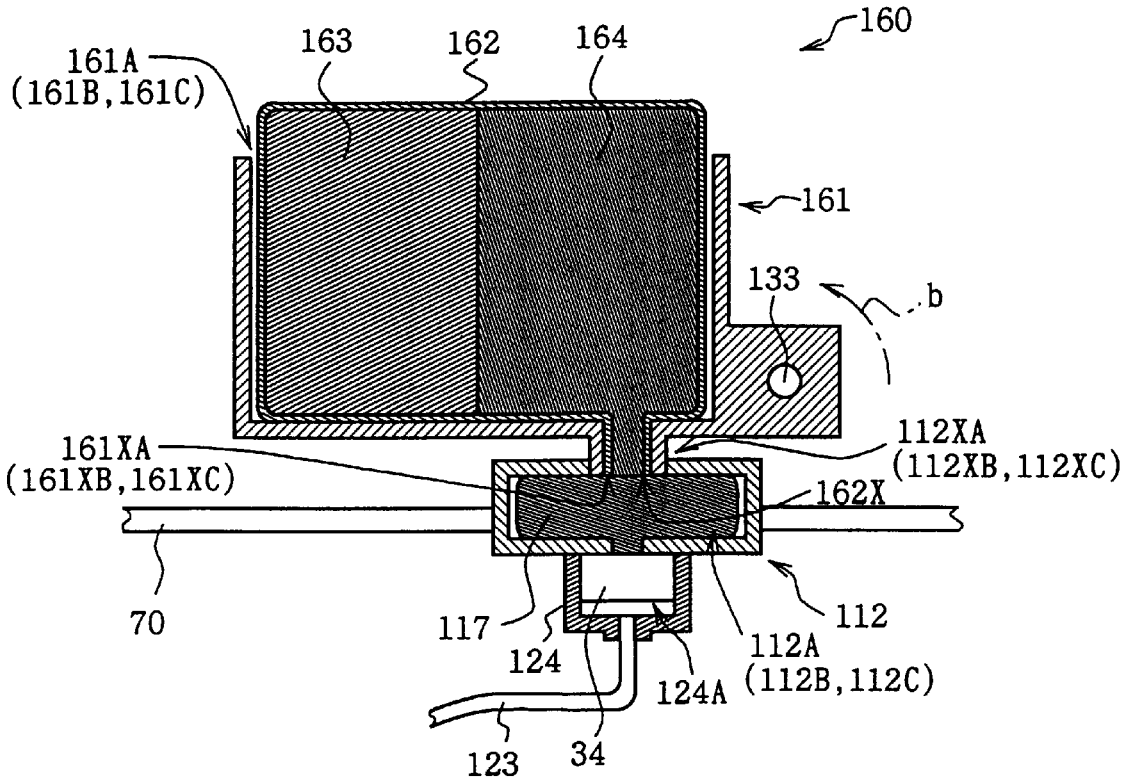
FIG. 20 is a partial cross section useful for explaining an operating state of another embodiment of the present invention with the print head at the maintenance position.

In the case of FIG. 20, two kinds of ink absorbers 163 and 164 with foaming rates that differ from each other are compressed and arranged in the ink storing vessel 162 shown in FIG. 20 so as to adjoin each other. The absorber materials are specifically selected so that the foaming rate of the ink absorber 164 at the protruding communicating port 162XA is smaller than that of the ink absorber 163. That is, the capillary force of the ink absorber 164 is larger than that of the ink absorber 163 but is smaller than that of the ink absorber 117 in the carriage 112.

In the case of the embodiment of FIG. 20, it is necessary to select the materials of the ink absorbers 163 and 164 and to select the allotment of the ink absorbers 163 and 164 in the ink storing vessel 136, so that the ink impregnated in the ink absorber 164 in the ink storing vessel 162 is held without leaking to the outside from the protruding communicating ports 162XA, 162XB, 162XC of the ink storing vessel 162. Therefore, the ink impregnated in the ink absorbers 163 and 164 in the ink storing vessel 162 is unidirectionally fed from the ink absorber 163 to the ink absorber 163 to the ink absorber 117 in the carriage 112. It is thereby possible to feed a stable amount of ink to the print head 34 independently of the shape of the ink storing vessel 136 in addition to the other beneficial effects of the above-described sixth embodiment.

Furthermore, in the sixth embodiment, apparatus is described in which three ink absorbers 141, 142, 143 are arranged in the ink storing vessel 136 so that they are superimposed with each other both vertically and horizontally, as shown in FIG. 18. The present invention is not restricted to the above case, however, and it is also possible to apply various location patterns to the several ink absorbers arranged in the ink storing vessel 136. In short, by maximizing the capillary force of the ink absorber of the ink storing vessel 136 at the protruding communicating port 136XA, it is possible to apply any pattern to the several ink absorbers and the allotment of them as arranged in the ink storing vessel 136.

Furthermore, in the above fourth, fifth, and sixth embodiments, apparatus is described in which the vacuum pump 122 is provided for the maintenance system 121 and the print head 34 is fitted into the head cap 124 that is connected to the vacuum pump 122 through the tube 123 to maintain the print head 34 free of debris by means of suction. The present invention is not restricted to the above case, however, and it is also possible to maintain the print head 34 by inserting a material, such as sponge, capable of absorbing various kinds of inks into the fitting portion 124A of the head cap 124, and thereby wiping the print head without using the suction pump or the tube at the maintenance station.

Additionally, in the above fourth, fifth and sixth embodiments, apparatus is described in which the print head 34 is maintained simultaneously with the operation of supplying the ink to the print head 34. The present invention is not restricted to the above case, however, and it is also possible to set the timing of the maintenance of the print head 34 and the timing of the feed of ink to the print head 34 so that a time lag occurs between the two operations, and it is also possible to perform either only one or both of the operations.

It should be understood that the above description is presented by way of example only and that various adaptations and modifications of the present invention may be made without departing from the spirit and scope of the invention, which should be determined solely by the appended claims.

What is claimed is:

1. A printer for printing on a recording medium comprising:

a carriage being movable over a range of motion relative to the recording medium and to at least one position beyond an extent of the recording medium and having an ink absorber material arranged therein;

a print head mounted for movement with said carriage and being in contact with the ink absorber material;

an ink container for storing a supply of ink; and ink supply transfer means for transferring a portion of said supply of ink from said ink container to said ink absorber material in said carriage by actuating said ink container to come into contact with said ink absorber material at said position of said carriage in said range of motion beyond an extent of the recording medium, wherein said ink container comprises a flexible bag holding a supply of ink and being arranged in a case body, said case body having a side wall with a through-hole formed therein, and wherein said ink supply transfer means comprises a pressing element for extending into said through-hole in said case body when said ink container comes into contact with said ink absorber material and an actuator for actuating said pressing element to apply pressure to said flexible bag and exude said supply of ink in said bag onto said ink absorber material, said flexible bag includes an S-shaped ink channel having an end thereof contacting said ink absorber material, and said pressing element includes a discoid cam and said actuator includes a rotary shaft connected by a belt and pulley to said discoid cam.

2. The printer according to claim 1, wherein said ink supply transfer means includes means for mounting said ink container for movement into and out of a path of said carriage in said range of motion.

3. The printer according to claim 2, wherein said means for mounting includes a rotary shaft arranged substantially perpendicularly to said path of said carriage.

4. The printer according to claim 1, further comprising a remaining ink sensor for detecting an amount of ink transfer and a signal processing control circuit connected to said remaining-ink sensor for calculating a remaining ink amount and controlling said ink supply transfer means to transfer said supply of ink to said print head.

* * * * *